US009290281B2

(12) United States Patent
Iwasa et al.

(10) Patent No.: US 9,290,281 B2
(45) Date of Patent: Mar. 22, 2016

(54) CARDBOARD BOX ASSEMBLY APPARATUS

(75) Inventors: Seisaku Iwasa, Shiga (JP); Yuji Yokota, Shiga (JP)

(73) Assignee: ISHIDA CO., LTD., Kyoto (JP)

( * ) Notice: Subject to any disclaimer, the term of this patent is extended or adjusted under 35 U.S.C. 154(b) by 653 days.

(21) Appl. No.: 13/396,225

(22) Filed: Feb. 14, 2012

(65) Prior Publication Data

US 2012/0208686 A1 Aug. 16, 2012

(30) Foreign Application Priority Data

Feb. 14, 2011 (JP) ..... 2011-028307

(51) Int. Cl.
*B31B 1/48* (2006.01)
*B65B 7/20* (2006.01)
*B31B 3/00* (2006.01)

(52) U.S. Cl.
CPC ... *B65B 7/20* (2013.01); *B31B 1/48* (2013.01); *B31B 3/00* (2013.01)

(58) Field of Classification Search
CPC ..... B31B 3/00; B31B 1/48; B31B 1/52; B31B 1/76; B31B 1/64; B31B 5/00; B31B 5/26; B31B 3/26; B31B 3/48; B31B 5/76; B31B 2201/28; B31B 2201/283; B31B 2201/288; B31B 2201/295; B31B 49/02; B31B 3/52; B65B 7/20
USPC ..... 493/162, 183, 309, 310, 312, 313, 453, 493/316; 53/482, 376.3, 376.4, 377.3, 53/371.9, 484, 491
See application file for complete search history.

(56) References Cited

U.S. PATENT DOCUMENTS

| | | | | | |
|---|---|---|---|---|---|
| 2,144,283 | A | * | 1/1939 | Bennett | 493/452 |
| 2,855,741 | A | * | 10/1958 | Shaw et al. | 53/377.3 |
| 3,289,553 | A | * | 12/1966 | Vadas et al. | 493/163 |
| 3,925,962 | A | * | 12/1975 | Knopf et al. | 53/527 |
| 4,524,560 | A | * | 6/1985 | Goodman | 53/377.3 |
| 4,584,818 | A | * | 4/1986 | Plaskett | 53/377.5 |
| 5,066,269 | A | * | 11/1991 | Center et al. | 493/183 |
| 5,102,382 | A | * | 4/1992 | Center et al. | 493/1 |

(Continued)

FOREIGN PATENT DOCUMENTS

| | | |
|---|---|---|
| JP | S49-021479 U | 6/1974 |
| JP | S54-042827 U | 12/1979 |

(Continued)

OTHER PUBLICATIONS

Office Action of the corresponding Japanese Patent Application No. 2011-028307, dated Sep. 24, 2014.

*Primary Examiner* — Michelle Lopez
*Assistant Examiner* — Eduardo R Ferrero
(74) *Attorney, Agent, or Firm* — Global IP Counselors, LLP

(57) ABSTRACT

A cardboard box assembly apparatus is a device for folding four panels constituting a lid section of a cardboard box, forming an interleaved lid where each of the four panels by overlaps adjacent ones of the four panels. The cardboard box assembly apparatus is provided with detruding members, locking members, and mover devices. The detruding members detrude respective first portions of the four panels. The locking members lock respective second portions of the four panels, preventing the second portions from moving in detrusion directions. Detrusion directions refer to directions of detrusion of the four panels. The mover devices move the locking members in a direction including at least a vertical direction component.

16 Claims, 26 Drawing Sheets

(56) References Cited

U.S. PATENT DOCUMENTS

| | | | | | |
|---|---|---|---|---|---|
| 5,352,178 | A * | 10/1994 | Pazdernik | 493/316 |
| 5,445,590 | A * | 8/1995 | Pazdernik | 493/317 |
| 5,454,776 | A * | 10/1995 | Ulrich et al. | 493/117 |
| 5,502,954 | A * | 4/1996 | Akiyama et al. | 53/504 |
| 5,558,614 | A * | 9/1996 | Anderson et al. | 493/312 |
| 5,624,368 | A * | 4/1997 | Cromwell | 493/312 |
| 7,571,587 | B2 * | 8/2009 | Goodman | 53/377.3 |
| 7,585,265 | B2 * | 9/2009 | Gebhardt et al. | 493/70 |
| 8,282,537 | B2 * | 10/2012 | Gebhardt et al. | 493/70 |
| 8,689,530 | B2 * | 4/2014 | Prahm et al. | 53/475 |
| 8,820,618 | B2 * | 9/2014 | Smith | 229/109 |
| 2003/0101693 | A1 * | 6/2003 | Hoe et al. | 53/491 |
| 2007/0293383 | A1 * | 12/2007 | Gebhardt et al. | 493/313 |
| 2009/0291816 | A1 * | 11/2009 | Gebhardt et al. | 493/313 |
| 2010/0173765 | A1 * | 7/2010 | Iwasa et al. | 493/183 |
| 2012/0208686 | A1 * | 8/2012 | Iwasa et al. | 493/162 |

FOREIGN PATENT DOCUMENTS

| | | | |
|---|---|---|---|
| JP | H11-278411 | A | 10/1999 |
| JP | 2010-274929 | A | 12/2010 |

* cited by examiner

CARDBOARD BOX ASSEMBLY APPARATUS

TECHNICAL FIELD

The present invention relates to cardboard box assembly apparatus for use in assembling a cardboard box into a box shape.

BACKGROUND ART

To date, cardboard boxes have been used for packaging articles for transport. Cardboard boxes are effective for purposes such as absorbing shocks to and preventing soiling of packaged articles, etc., and are used in most distribution channels.

In order to effectively utilize earth's resources, recycling practices have become increasingly frequent in recent years. The four panels making up a lid section of a cardboard box fold in an interleaved manner for transport, allowing the cardboard box to be recycled. Also, once articles have been removed from a cardboard box, other articles may be repackaged in the cardboard box, again folding in an interleaved manner the four panels making up the lid section of the cardboard box for transport. U.S. Pat. No. 5,352,178 discloses a cardboard box folding device.

In the cardboard box folding device disclosed in U.S. Pat. No. 5,352,178, the cardboard box is carried to a predetermined location by a conveyor device, where a first small flap and a second large flap are driven simultaneously. The first small flap pushes a corner of one edge of one panel constituting the bottom of the cardboard box, the second large flap pushes a corner of one edge of another panel constituting the bottom of the cardboard box, and the other corners of the one panel and the other panel are suctioned by a plurality of vacuum suction devices to form an interleaved cardboard box.

Also, for example, Japanese Laid-open Patent Application 11-278411 discloses a method for folding down a side flap of a paper container, whereby a side flap of a paper container spreading beyond a predetermined range can be folded down in the direction of transport, and a device therefor.

The device for folding down a side flap of a paper container disclosed in Japanese Laid-open Patent Application 11-278411 is provided with a conveyor arranged in a substantially horizontal fashion. The conveyor is furnished at predetermined intervals with support panels for supporting the paper containers. The paper container has at least at the top side thereof a flapped opening, and is fabricated in a three-dimensional form so as to open up the opening. The support panels support the paper containers with the opening of the paper container facing to one side. Posture correcting means is furnished midway along the direction of transport of the conveyor so that the posture correcting means may not interfere with the paper container during transport by the conveyor. The posture correcting means brings about displacement, towards an erection direction, of the side flap which is formed at the rear side in the direction of transport in the opening and has been extended (flattened) towards the outward direction from the opening. A tucker is furnished to the side of the conveyor. The side flap having undergone displacement towards the erection direction by the posture correcting means is turned to the direction of transport by the tucker so as to effect flattening towards the inside from the opening.

U.S. Patent Application 2010-0173765-A1 discloses a cardboard box assembly apparatus whereby a recyclable cardboard box can be assembled by a simple configuration, and with the cardboard box being assembled at low cost.

The cardboard box assembly apparatus disclosed in U.S. Patent Application 2010-0173765-A1 is adapted to fold over on one another the four panels constituting a lid section of the cardboard box, forming an interleaved lid. The cardboard box assembly apparatus includes a locking member and a fold-over member. By means of an elastic member, the locking member locks one edge of each of four panels constituting the lid section of the cardboard box. The fold-over member detrudes another edge of each of the four panels constituting the lid section of the cardboard box. In this cardboard box assembly apparatus, each of the four panels constituting the lid section of the cardboard box are held at a first edge thereof through elastic force of the elastic member of the locking member, while the another edges of each of the four panels constituting the lid section of the cardboard box continue to be fold over by the fold-over member. Where the elastic force of the elastic member of the locking member is exceeded, the first edges of each of the four panels constituting the lid section of the cardboard box are released.

DISCLOSURE OF THE INVENTION

Technical Problem

However, the cardboard box folding device disclosed in U.S. Pat. No. 5,352,178 holds one panel of the cardboard box with vacuum suction devices, and therefore is unsuitable for forming an interleaved shape when a cardboard box is recycled.

Typically, when a cardboard box is recycled, because the corrugated cardboard box has previously been used and transported, the surface of the cardboard box may be soiled or bent. In cases of soiling, there is increased load on the vacuum suction devices when the suction is applied to the surface of the cardboard box by the vacuum suction devices. In cases of bent surfaces, the vacuum suction device may not be able to apply suction.

An object of the present invention is to provide cardboard box assembly apparatus capable of assembling a recycled or new cardboard box by means of a simple configuration, and of reliably assembling the corrugated cardboard box at low cost.

(1) The cardboard box assembly apparatus according to the present invention folds four panels constituting the lid section of a cardboard box to form an interleaved lid. The interleaved lid is formed by overlap of a plurality of adjacent panels among the four panels. The cardboard box assembly apparatus is provided with detruding members, locking members, and mover devices. The detruding members detrude respective first portions of the four panels. The locking members lock respective second portions of the four panels, thereby preventing the second portions from moving in detrusion directions. Detrusion directions refer to directions of detrusion of the four panels. The mover devices move the locking members in a direction including at least a vertical direction component.

With the cardboard box assembly apparatus according to the present invention, the detruding members push first portions of the four panels constituting the lid section. The locking members lock portions of the four panels constituting the lid section. The locking members are moved in a direction including at least an upward component in the vertical direction by the mover devices. Through this movement of the locking members by the mover devices, the panels are released from being locked by the locking members. In so doing, a fold for sealing purposes or an interleaved lid of a cardboard box can be formed in a reliable manner, irrespective of the state of a lid section, or of the state of a lid of a recycled cardboard box, a new cardboard box, or the like.

(2) In preferred practice, the cardboard box assembly apparatus is designed so that once the second portions are locked by the locking members and the first portions begin to undergo detrusion by the detruding members, the mover devices move the locking members upward in the vertical direction, and the detruding members further detrude the first portions.

In this case, after the second portions of panels have been locked by the locking members and the first portions have begun to be detruded by the detruding members, the mover devices move the locking members upward in the vertical direction, and the detruding members further detrude the first portions. Once the second portions are released from the locking members through this upward movement of the locking members in the vertical direction, the second portions flatten later than the first portion. For two adjacent panels, with the first portion of a first panel and the second portion of a second panel adjacently situated, locking member lock the second portion of the first panel and the second portion of the second panel, and detruding member detrude the first portion of the first panel and the first portion of the second panel. Once the locking members are moved upward in the vertical direction by the mover device, the second portion of the first panel and the second portion of the second panel are released from the locking members, whereby the second portion of the first panel and the second portion of the second panel are detruded later than the first portion of the first panel and the first portion of the second panel. In so doing, part (the first portion) of one panel (the first panel) can be inserted below part (the second portion) of an adjacent panel (the second panel).

(3) The locking members may include a plate member tilted along the detrusion direction with respect to a horizontal plane.

Because the locking members include a plate member tilted towards the detrusion direction, once the locking members move upward in the vertical direction, the lid section of the cardboard box is progressively closed. As a result, an interleaved lid can be reliably formed on the cardboard box. Moreover, because the plate member is inclined, even if panels constituting the lid section of the cardboard box are bent by virtue of being recycled, a bent lid can be locked. In so doing, an interleaved lid can be reliably formed on the cardboard box.

(4) Further, in preferred practice, the locking members include an angle adjusting mechanism for adjusting tilt of the plate member with respect to the horizontal plane.

In this case, because the locking members have an angle adjusting mechanism, angle adjustment of the plate member can be performed according to the size of the cardboard box. As a result, various kinds of cardboard boxes can be assembled, and versatility can be improved.

(5) Further, in preferred practice, the locking members include a rotation mechanism, the rotation mechanism being adapted to move the plate member from below to above in the detrusion direction.

In this case, the locking member can move the plate member upward from below in the detrusion direction with the rotation mechanism. While being moved upward in the vertical direction by the mover device, the locking member can distance the plate member from the lid section in a short time by the rotation mechanism. As a result, the time needed to form an interleaved lid can be shortened. Further, the time needed for detrusion by the detruding member can be shortened.

(6) Also, in preferred practice, the mover devices hold a plurality of locking members in an integrated manner.

In this case, the mover devices hold a plurality of locking members in an integrated manner. Because of this, the plurality of locking members can be simultaneously moved upward in the vertical direction through driving by the mover device. Thus, because a plurality of panels of a cardboard box can be detruded simultaneously, an interleaved lid can be formed in a reliable manner.

(7) Also, the mover devices may respectively hold the plurality of locking members in independent fashion.

In this case, each of a plurality of mover devices may hold one of the plurality of locking members. Specifically, each of the plurality of locking members is independently moved upward in the vertical direction by a mover device. As a result, changes in shape of cardboard boxes can be accommodated, and the versatility of the cardboard box assembly apparatus can be enhanced.

(8) In preferred practice the cardboard box assembly apparatus is further provided with pushing members. Once the four panels have been overlapped, the pushing members push the lid downward from above in a vertical direction.

In this case, after an interleaved lid has been formed in a cardboard box, the lid is pushed downward from above in the vertical direction by the pushing member. As a result, the interleaved lid of the cardboard box can be prevented from collapsing. Particularly in the case of new cardboard boxes, the four panels constituting the lid section are frequently prone to return in the opposite direction from the detrusion direction. However, because the interleaved lid is held in a reliable manner through pushing by the pushing member, collapse of the interleaved lid of the cardboard box can be prevented.

(9) In preferred practice, the cardboard box assembly apparatus is further provided with lid erection devices. The lid erection devices are adapted to change the posture of the four panels furnished extending from the side walls of the cardboard box to an upright posture. Also, in preferred practice, the lid erection devices include a rod member and a rotation device. The rod member has a distal end section, and through rotational movement the distal end section is moved along the side wall towards the panels from the corresponding side wall. The rotation device brings about rotational movement of the rod member.

In this case, rotational movement of the rod member is brought about by the rotation device, and the distal end of the rod member is moved along the side wall from the side wall towards a panel. In so doing, each of the four panels constituting the lid of the cardboard box can be erected along the side wall. At the same time, each panel can be clamped between the locking member and the rod member. Also, because rotational movement of the rod member is brought about by the rotation device, and because vacuum unit does not move around a space unlike the case where a vacuum suction device and the like are used, less space is required.

Advantageous Effects of Invention

According to the present invention, a recycled or new cardboard box can be assembled by means of a simple configuration, and in a reliable manner.

BRIEF DESCRIPTION OF THE DRAWINGS

FIG. 20 is a schematic diagram showing symptoms arising in a case where an interleaved lid has been formed on a new cardboard box or the like.

BEST MODE FOR CARRYING OUT THE INVENTION

An embodiment according to the present invention is described below with reference to the drawings. The present embodiment describes cardboard box assembly apparatus for assembly of a lid portion of a cardboard box. The portion assembled by the cardboard box assembly apparatus is not limited to a lid portion. For example, the cardboard box assembly apparatus may be provided for assembly of the bottom portion of a cardboard box. It is also possible for the cardboard box assembly apparatus to be implemented in assembly of a lid portion and a bottom portion of a box made of other types of paper.

First Embodiment

First, the cardboard box assembly apparatus according to the present invention is described with reference to the drawings. FIGS. 1 through 7 are schematic diagrams depicting an example of interleaved lids of a cardboard box 900 and example of lids in an erected state.

Figure 1:
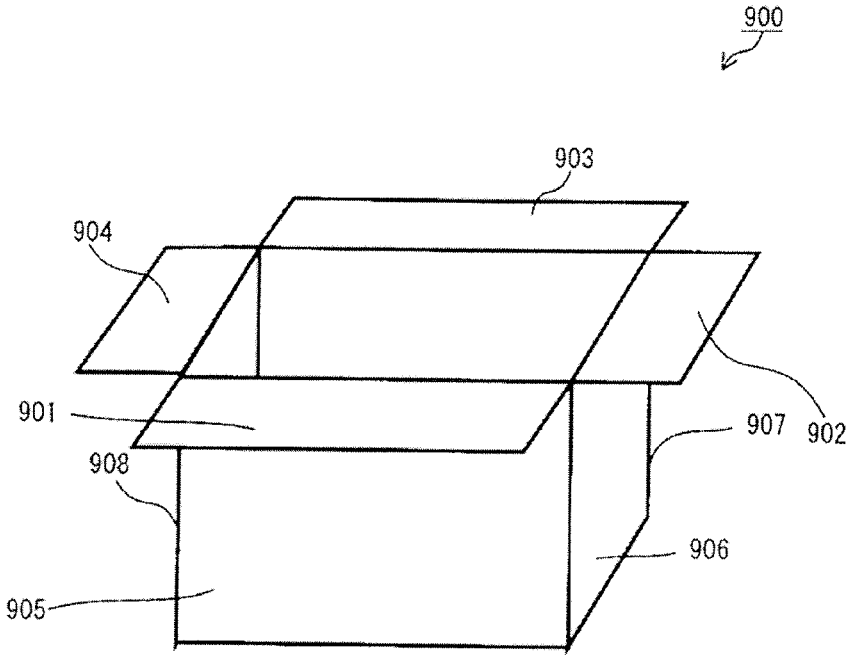
FIG. 1 is a schematic diagram showing a cardboard box with the lid (panels) open.

FIG. 1 shows the cardboard box 900 with the lid (panels 901 to 904) open. Herein, in the present embodiment, a state in which the panels 901 to 904 are bent outward is termed the open lid state.

As shown in FIG. 1, the cardboard box 900 is formed by side walls 905, 906, 907, 908, and panels 901, 902, 903, 904. The panel 901 is positioned above the side wall 905. The panel 902 is positioned above the side wall 906. The panel 903 is positioned above the side wall 907. The panel 904 is positioned above the side wall 908.

With the lid of the cardboard box 900 open as shown in FIG. 1, the panel 901 is positioned to the outside of the side wall 905 (to the outside of the area bounded by the side walls 905 through 908), the panel 902 is positioned to the outside of the side wall 906, the panel 903 is positioned to the outside of the side wall 907, and the panel 904 is positioned to the outside of the side wall 908. In other words, the panels 901 to 904 extend to the outside of the side walls 905 to 908, from the upper edges of the side walls 905 to 908 of the cardboard box 900.

Figure 2:
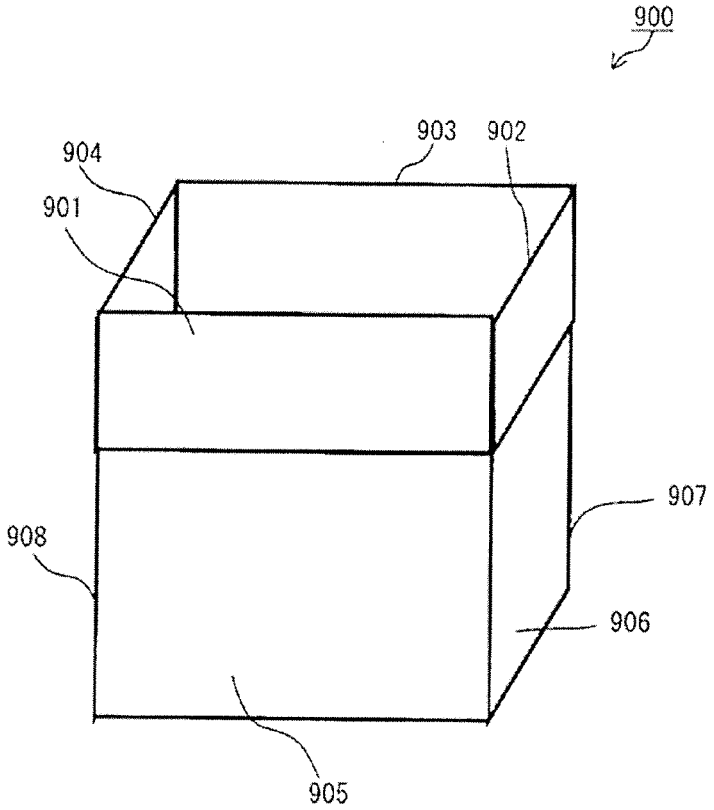
FIG. 2 is a schematic diagram showing a cardboard box with the lid (panels) in an upright state.

FIG. 2, on the other hand, shows the cardboard box 900 with the lid (panels 901 to 904) in an erect state. Herein, the state of the cardboard box 900 of FIG. 2 is called the erect lid state (or upright lid state). When the cardboard box 900 is in the erect lid state as shown in FIG. 2, the panel 901 is positioned vertically above the side wall 905, the panel 902 is positioned vertically above the side wall 906, the panel 903 is positioned vertically above the side wall 907, and the panel 904 is positioned vertically above the side wall 908.

Figure 3:
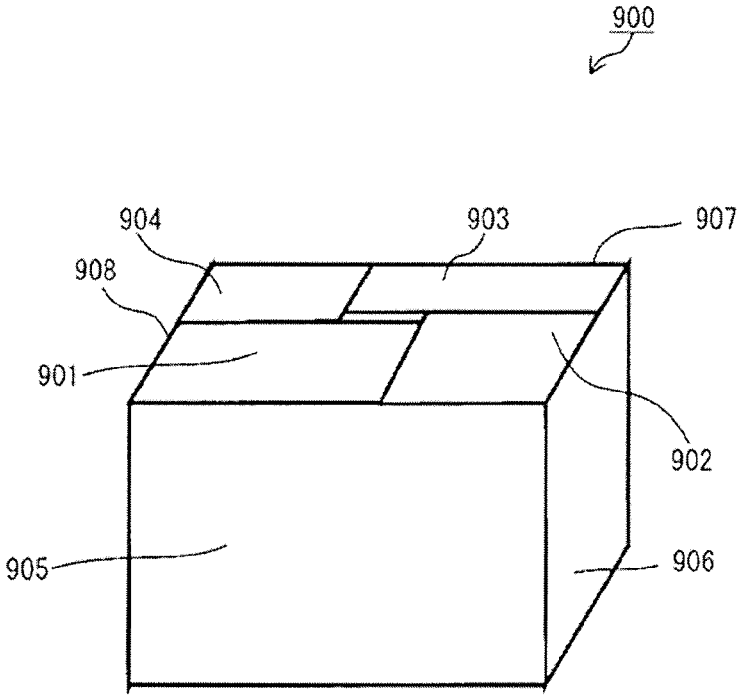
FIG. 3 is a schematic diagram showing an example of an interleaved lid of a cardboard box.
Figure 4:
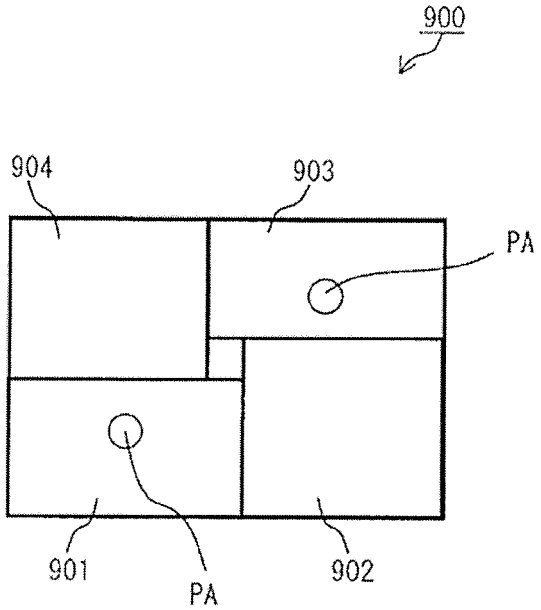
FIG. 4 is a schematic diagram showing a top view of the interleaved lid of a cardboard box.

FIGS. 3 and 4 show the cardboard box 900 with the lid closed. In the cardboard box 900 shown in FIGS. 3 and 4, the panel 901, the panel 902, the panel 903, and the panel 904 have been folded in that order while juxtaposing portions of each of the panels 901 to 904 against one another. In other words, in the cardboard box 900, a second edge section (a second portion) of each of the panels 901 to 904 are folded over a first edge section (a first portion) of each of the panels 901 to 904. The state of the cardboard box 900 of FIGS. 3 and 4 is termed a state of interleaved closure of the lid (interleaved lid).

Figure 5:
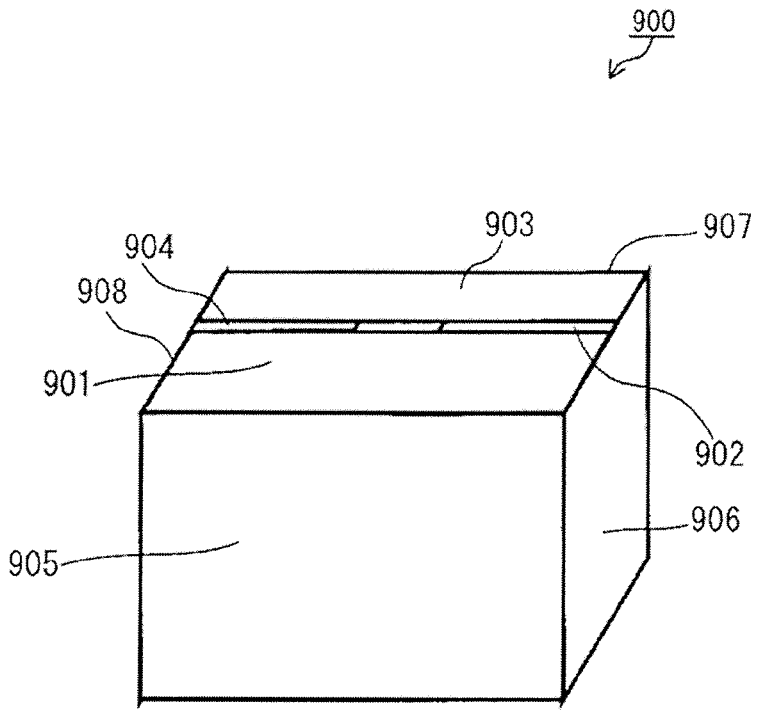
FIG. 5 is a schematic diagram showing an example of the cardboard box with lid which is not interleaved.

Further, FIG. 5 shows an example of the cardboard box 900 with the lid which is not interleaved. In the cardboard box 900 shown in FIG. 5, the panels 901 and 903 have been superimposed over the folded panels 902 and 904. In most instances, in a subsequent process, the cardboard box 900 of FIG. 5 will be sealed at edge portions in proximity to the panels 901 and 903. The state of the cardboard box 900 in FIG. 5 is termed the unsealed, closed lid state.

The cardboard box 900 shown in FIG. 1 is transported with the lid open. After articles have been placed inside the cardboard box 900 by a packing device (not shown) furnished upstream, the cardboard box 900 is sent to the cardboard box assembly apparatus 100 of the present embodiment.

Next, as shown in FIG. 2, the cardboard box assembly apparatus 100 according to the present embodiment places the cardboard box 900 in an erect lid state. Thereafter, the cardboard box assembly apparatus 100 detrudes the panels 901 to 904, forming an interleaved lid on the cardboard box 900 as shown in FIGS. 3 and 4.

The panels 901, 903 are identical in shape, and the panels 902, 904 are identical in shape.

Figure 6:
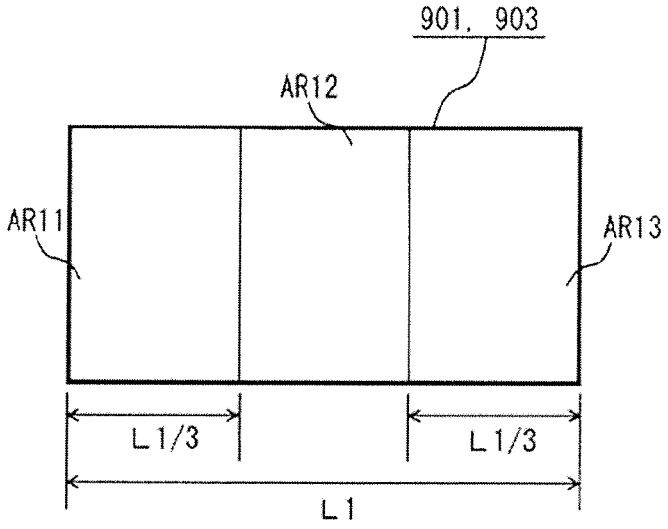
FIG. 6 is a schematic diagram showing a panel of a cardboard box.
Figure 7:
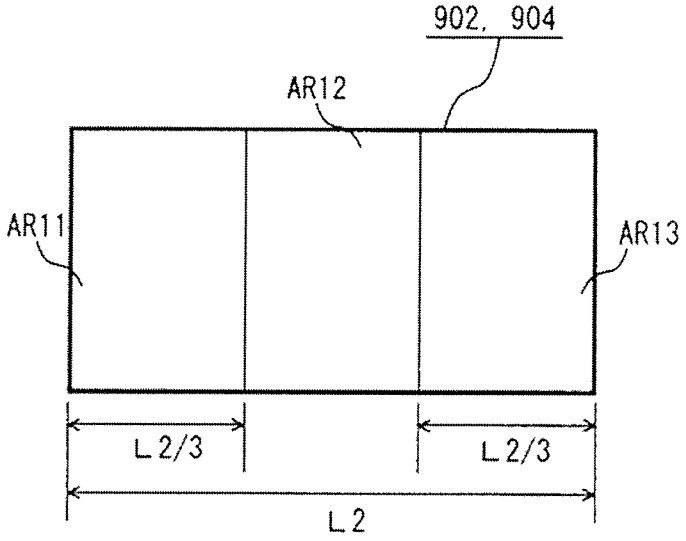
FIG. 7 is a schematic diagram showing another panel of the cardboard box.

The panels 901 to 904 will be described here with FIGS. 6 and 7. FIG. 6 is a diagram describing the panels 901 and 903. FIG. 7 is a diagram describing the panels 902 and 904. The lines shown in FIGS. 6 and 7 are hypothetical lines describing the panels of the cardboard box 900.

As shown in FIG. 6, the panels 901 and 903 have an area AR11, an area AR12, and an area AR13. The area AR11 is an area bounded by a side having a predetermined height equal to the height of the panel, and a side having a length from about at least 0 to less than (L1)/3 in a horizontal direction. The area AR12 is an area bounded by a side having the predetermined height, and a side having a length from about at least (L1)/3 to less than 2(L1)/3 in a horizontal direction. The area AR13 is an area bounded by a side having the predetermined height, and a side having a length from about 2(L1)/3 to no more than L1 in a horizontal direction.

Likewise, the panels 902, 904 shown in FIG. 7 have an area AR11, an area AR12, and an area AR13. The area AR11 is an area bounded by a side having a predetermined height equal to the height of the panel, and a side having a length from about at least 0 to less than (L2)/3 in a horizontal direction. The area AR12 is an area bounded by a side having the predetermined height, and a side having a length from about at least about (L2)/3 to less than 2(L2)/3 in a horizontal direction. The area AR13 is an area bounded by a side having the predetermined height, and a side having a length from about 2(L2)/3 to L2 in a horizontal direction.

The areas AR11, AR12, AR13 of the panels 901 to 904 shown in FIGS. 6 and 7 are employed for the purpose of describing assembly of a cardboard box (form of lid portion) by the cardboard box assembly apparatus 100 according to the present invention. Accordingly, the number of areas belonging to each of the panels 901 to 904 is not limited to the three areas AR11, AR12, AR13; the two areas AR11 and AR13 would be acceptable as well. Also, the areas may be defined by any other method of demarcation.

Please note that, according to the present embodiment, the AR11, AR12, AR13 are arranged clockwise in each of the panels 901 to 904 in the planar view of the cardboard box 900 with open lid state (see FIG. 1). Also, according to the present embodiment, a flat plate 411 to 414 of the interleaved folding mechanisms 401 to 404 respectively contacts the AR11 (the first edge section) (a first portion) of each of the panels 901 to 904. Also, a contact surface 320SU of the locking members 301 to 304 respectively contacts the AR13 (the second edge section) (a second portion) of each of the panels 901 to 904.

While a cuboid cardboard box 900 was described in FIGS. 1 to 7, the cardboard box assembly apparatus 100 according to the present invention can be implemented for regular hexahedral cardboard boxes as well.

Figure 8:
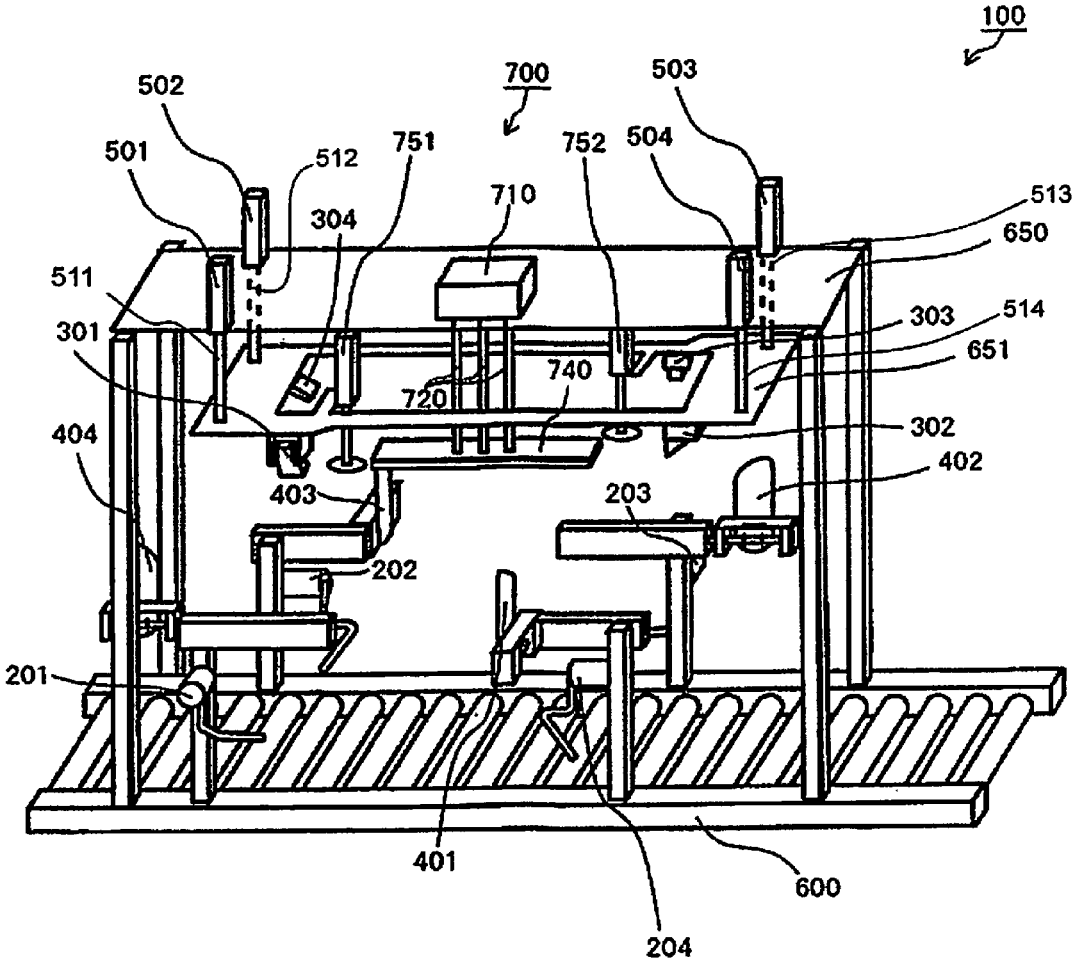
FIG. 8 is a schematic exterior view of a cardboard box assembly apparatus that includes a plurality of locking members, a plurality of lid erection devices and a plurality of interleaved folding mechanisms according to the present embodiment.
Figure 9:
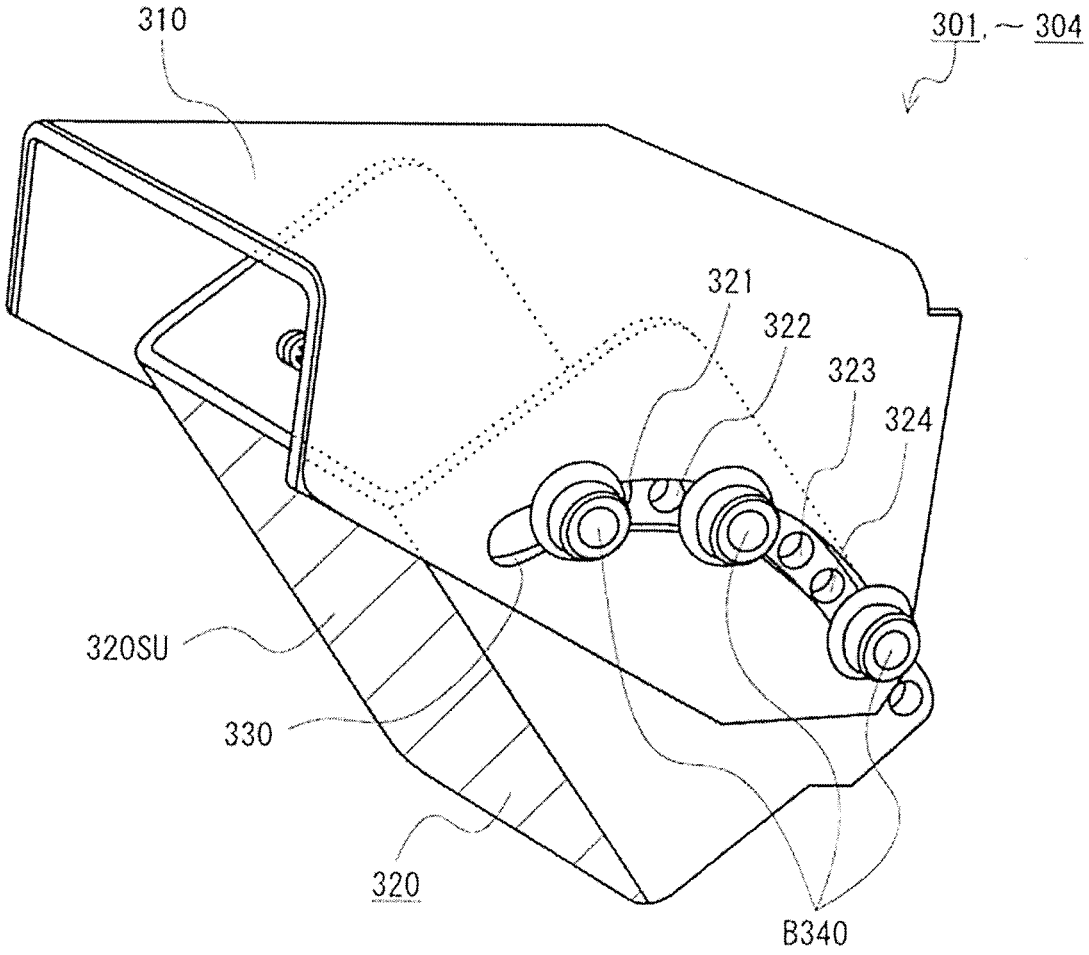
FIG. 9 is a schematic diagram one of the locking members shown removed from the cardboard box assembly apparatus.
Figures 10A, 10B:
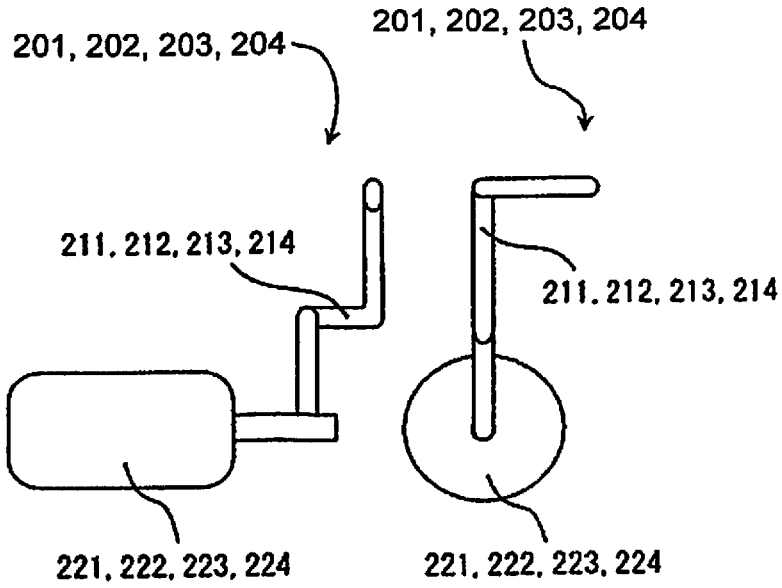
FIG. 10*a* and FIG. 10*b* are schematic diagrams including an elevation view and a side view of one of the lid erection devices shown removed from the cardboard box assembly apparatus.
Figure 11:
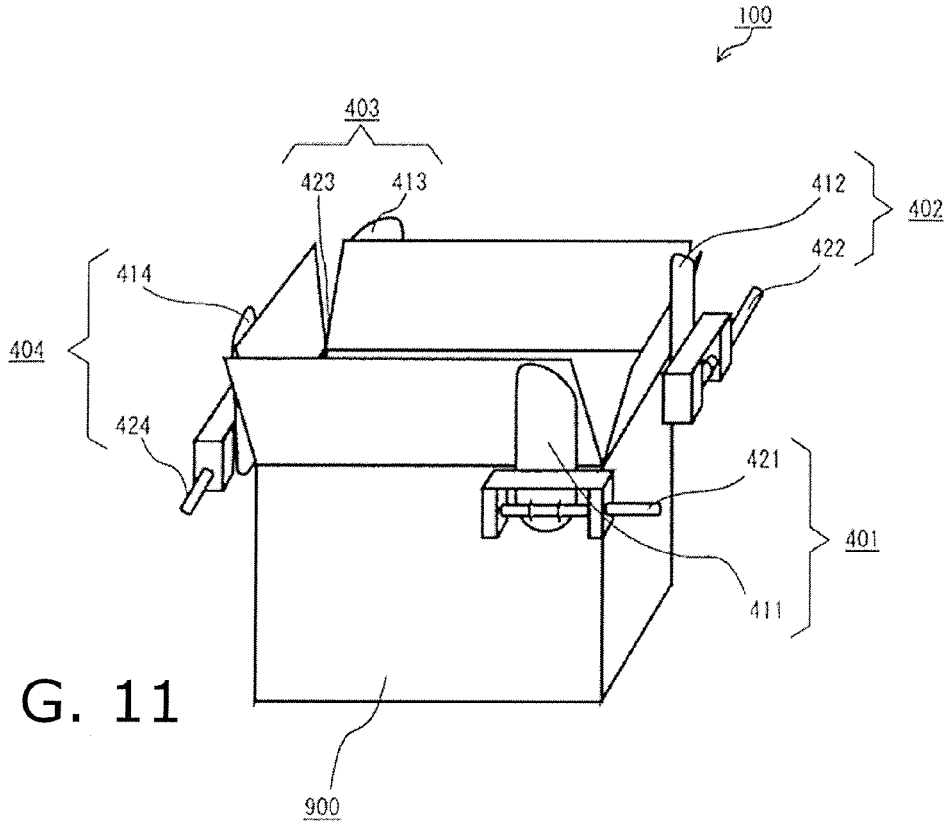
FIG. 11 is a schematic diagram showing the plurality of interleaved folding mechanisms located about the lid panels of a cardboard box, with other features of the cardboard box assembly apparatus omitted.
Figure 12:
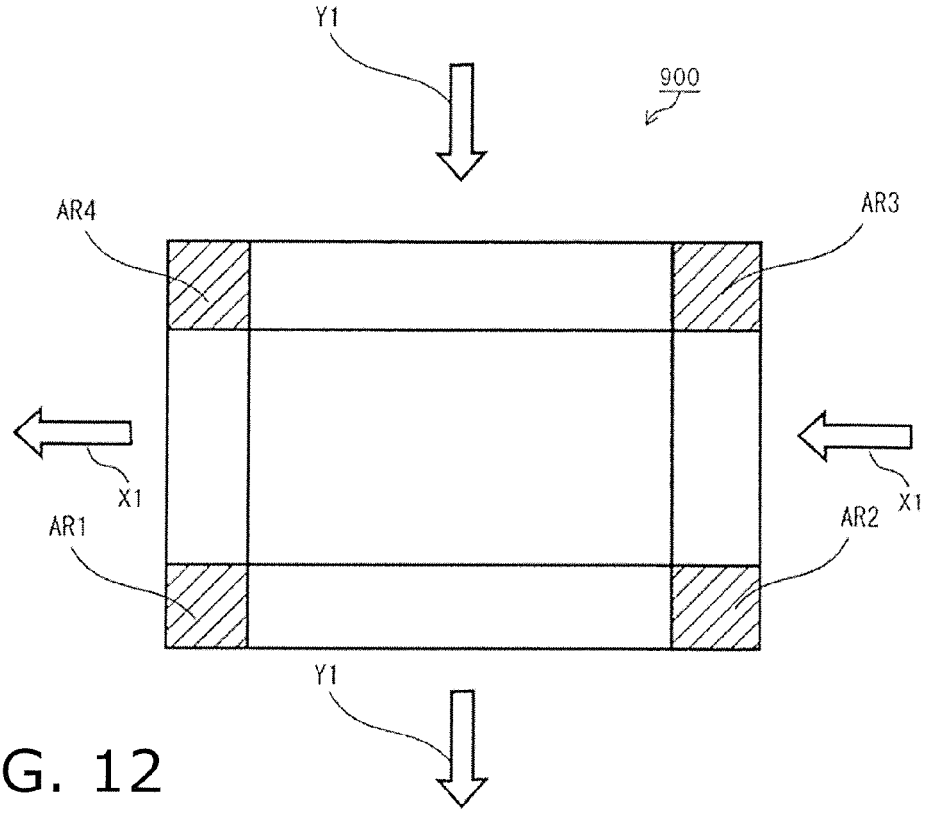
FIG. 12 is a schematic diagram showing a cardboard box and installation positions relative to the cardboard box where the lid erection devices are installed.

FIG. 8 is a schematic exterior view showing an example of cardboard box assembly apparatus 100 according to the present embodiment. The cardboard box assembly apparatus 100 can be controlled by an electronic controller (not shown). FIG. 9 is a schematic diagram showing in detail a plurality of locking member housed within the cardboard box assembly apparatus 100. FIG. 10 is a schematic diagram showing an example of an elevation view and a side view of one lid erection devices 201-204 of four lid erection devices 201-204 that are housed within the cardboard box assembly apparatus 100. All four of the lid erection devices 201-204 are shown in FIGS. 8 and 13-17. Since the four lid erection devices 201-204 are basically the same as one another, description of one applies to all four lid erection devices 201-204. Specifically, FIG. 10(*a*) shows a front face of one of the lid erection devices 201-204, and FIG. 10(*b*) shows a side face of one of the lid erection devices 201-204. FIG. 11 is a schematic diagram showing in detail a plurality of interleaved folding mechanisms 401 to 404. FIG. 12 is a schematic diagram in top view of the cardboard box 900 showing installation positions or areas AR1, AR2, AR3 and AR4 representing contact areas where the lid erection devices 201 to 204 and the interleaved folding mechanisms 401 to 404 are installed, described in greater detail below.

First, as shown in FIG. 8, the cardboard box assembly apparatus 100 principally includes mover devices 501 to 504, locking members 301 to 304, lid erection devices 201 to 204, interleaved folding mechanisms 401 to 404, a transport device 600, an infold-preventing member 700, and pushing devices 751, 752. The plurality of the locking members (301 thru 304), the plurality of lid erection device 200, the plurality of interleaved folding mechanisms 401 to 404, and more specifically, the mover devices 501 to 504, the transport device 600, the infold-preventing member 700, and the pushing devices 751, 752 are all controlled by the electronic controller (not shown) such that operation of the cardboard box assembly apparatus 100 can be completely automated.

The mover devices 501 to 504 are devices for moving the locking members 301 to 304, discussed below, up and down in a vertical direction. Specifically, the mover devices 501 to 504 are composed of extensible rods 511 to 514. The extensible rods 511 to 514 elongate in a vertical downward direction (direction Z1 in the drawing) (see FIG. 13).

The mover devices 501 to 504 are fastened at the upper edge to a fastening section 650 of the cardboard box assembly apparatus 100. The fastening section 650 is a member disposed to the upper side in the heightwise direction of the cardboard box assembly apparatus 100. As shown in FIG. 8, for example, the fastening section 650 is a member that extends parallel to a horizontal plane at the upper side in the heightwise direction of the cardboard box assembly apparatus 100. A slide device 710 of the infold-preventing member 700, discussed below, is also fastened to the fastening section 650.

The mover devices 501 to 504 are attached at their bottom edge section to an ascending/descending frame 651. The ascending/descending frame 651 is a member disposed below the fastening section 650 in the heightwise direction of the cardboard box assembly apparatus 100. The ascending/descending frame 651 is also a member extending parallel to a horizontal plane. The ascending/descending frame 651 moves in an ascending or descending direction through extension and retraction of the extensible rods 511 to 514. The locking members 301 to 304 are attached to the ascending/descending frame 651. The details of operation of the devices will be discussed below.

Next, the locking members 301 to 304 are discussed with reference to FIG. 9. The locking members 301 to 304 are members for locking one edge of each of the panels 901 to 904 so as to maintain the panels 901 to 904 in an erect posture. The locking members 301 to 304 are composed of a fastening section 310, a movable section 320, and bolts B340.

As shown in FIG. 9, the fastening section 310 is composed of a generally "C" shape. Specifically, the fastening section 310 is composed of a flat surface section, and side surface sections extending downward from either widthwise side of the flat surface section. More specifically, the fastening section 310 has a recessed shape with the flat surface section as its top surface, and a downward-facing recessed section. The flat surface section has a posture parallel to a horizontal plane. A slot 330 is formed in the fastening section 310. Specifically, the slot 330 is formed in a side surface section. The slot 330 has an opening of arcuate shape.

The movable section 320 is composed of a generally "C" shape and is insertable within the fastening section 310. Specifically, the movable section 320 is composed of a flat surface section of rectangular shape, and side surface sections extending upward from either widthwise side of the flat surface section. More specifically, the movable section 320 has a recessed shape with the flat surface section as its bottom surface, having an upward-facing recessed section. The movable section 32 inserts within a fastening section space in such a way that a space bounded by the flat surface section and the side surface sections thereof face towards a space bounded by the flat surface section and the side surface sections of the fastening section 310 (the fastening section space). Also, the movable section 320 inserts within the fastening section space in such a way that the flat surface section of the movable section 320 has an incline with respect to the flat surface section of the fastening section 310. The movable section 320 is provided with a contact surface (plate member) 320SU (shown by hatching) for temporarily holding a panel of the cardboard box. The contact surface 320SU is provided over the entire surface of the flat surface section. The contact surface 320SU is a plate-shaped member, the member having a high frictional force (for example, elastic member) or showing high rigidity.

A side wall surface of the movable section 320 face a side wall surface of the fastening section 310. Specifically, an outside of the side wall surface of the movable section 320 contacts an inside of the side wall surface of the fastening section 310. A plurality of holes 321 to 324 (plurality of holes) are formed in a side wall surface of the movable section 320. The plurality of holes are disposed so as to describe an arc. Specifically, the plurality of holes are respectively disposed to coincide with the shape of the opening of the slot 330 formed in the fastening section 310. In other words, the plurality of holes are disposed so as to describe the arc.

The fastening section 310 and the movable section 320 are fastened by the bolts B340. The bolts B340 pass through the slot 330 formed in a side surface section of the fastening section 310 and through any of the plurality of holes, and fasten the fastening section 310 and the movable section 320.

The incline of the movable section 320 with respect to the fastening section 310 (the angle of the flat surface section of the movable section 320 with respect to the flat surface section of the fastening section 310) can be changed by changing the attachment position of the bolts B340 of FIG. 9. As a result, the angle of the contact surface 320SU with respect to a horizontal plane can be changed. That is, the bolts B340, the slot 330, and the plurality of holes 321 to 324 perform as an angle adjustment mechanism which changes the inclination of the contact surface 320SU with respect to a horizontal plane. For example, the contact surface 320SU is furnished at an angle of less than 90 degrees, preferably a range from 30 degrees to 80 degrees, more preferably a range from 45 degrees to 65 degrees, and still more preferably 50 degrees, with respect to a horizontal plane.

When the locking members 301 to 304 have been moved to a downward position through extension of the extensible rods 511 to 514, the contact surfaces 320SU of the locking members 301 to 304 contact the insides and/or tops of the panels 901 to 904 in an erect posture. The locking members 301 to 304 are respectively disposed with their contact surfaces 320SU inclined along the detrusion direction with respect to a horizontal plane. The detrusion direction refers to the direction for detrusion of the panels 901 to 904.

Next, FIG. 10 shows the lid erection devices 201 to 204. The lid erection devices 201 to 204 are devices for changing the opened panels 901 to 904 to an erect state. The lid erection devices 201 to 204 are composed of a first lid erection device 201, a second lid erection device 202, a third lid erection device 203, and a fourth lid erection device 204. The first lid erection device 201 is composed of a motor 221 and a rod member 211. The second lid erection device 202 is composed of a motor 222 and a rod member 212. The third lid erection device 203 is composed of a motor 223 and a rod member 213. The fourth lid erection device 204 is composed of a motor 224 and a rod member 214. The motors 221 to 224 bring about respective rotating motion by the rod members 212 to 214. Each of the rod members 212 to 214 has a distal end section. Through rotating motion, the rod members 212 to 214 move their distal end sections along the side walls from the side walls 905 to 908 towards the panels 901 to 904. The opened panels 901 to 904 are erected through movement of the distal end sections of the rod members 212 to 214 along the side walls from the side walls 905 to 908 to the panels 901 to 904.

To continue, the interleaved folding mechanisms 401 to 404 are shown in FIG. 11. The interleaved folding mechanisms 401 to 404 are mechanisms for detruding (folding) the panels 901 to 904 towards the direction of closure of the opening of the cardboard box 900 so as to form a lid. The interleaved folding mechanisms 401 to 404 include a first interleaved folding mechanism 401, a second interleaved folding mechanism 402, a third interleaved folding mechanism 403, and a fourth interleaved folding mechanism 404. The first interleaved folding mechanism 401 is composed of a flat plate 411 and a driving mechanism 421. The second interleaved folding mechanism 402 is composed of a flat plate 412 and a driving mechanism 422. The third interleaved folding mechanism 403 is composed of a flat plate 413 and a driving mechanism 423. The fourth interleaved folding mechanism 404 is composed of a flat plate 414 and a driving mechanism 424. The first interleaved folding mechanism 401, the second interleaved folding mechanism 402, the third interleaved folding mechanism 403, and the fourth interleaved folding mechanism 404 all have identical configuration. Accordingly, the flat plate 411 and the driving mechanism 421 of the first interleaved folding mechanism 401 will be described below.

The driving mechanism 421 has a support shaft extending parallel to a horizontal plane. The flat plate 411 has a flat surface section. The flat plate 411 waits in a first posture with the flat surface section orthogonal to the horizontal plane. The lower edge section of the flat plate 411 is rotatably supported by the support shaft. Through driving the driving mechanism 421, the flat plate 411 is rotated about a horizontal axis with respect to the lower edge section thereof. The flat plate 411 rotates in a direction such that the flat surface section is parallel to the horizontal plane.

The driving mechanism 421 also moves the support shaft within the horizontal plane, changing the planar position of the flat plate 411 with respect to the cardboard box 900. Specifically, the driving mechanism 421 changes the plane of the flat plate 411 from a first planar position at a position away from a side wall of the cardboard box 900, to a second planar position parallel to the side wall of the cardboard box 900 (the direction of arrow R1 of FIG. 15).

The lid erection devices 201 to 204 and the interleaved folding mechanisms 401 to 404 are respectively disposed in the area AR1, the area AR2, the area AR3, and the area AR4, shown in FIG. 12. The area AR1, the area AR2, the area AR3, and the area AR4 are areas positioned on an extension of the diagonal of the cardboard box 900. In other words, the area AR1, the area AR2, the area AR3, and the area AR4 are areas defined between two neighboring panels of the cardboard box 900 with the lid open. Because the lid erection devices 201 to 204 and the interleaved folding mechanisms 401 to 404 are disposed in areas positioned on an extension of the diagonal of the cardboard box 900, the cardboard box 900 can be moved in the direction of arrow X1 and the direction of arrow Y1, or in the opposite direction from arrow X1 and the opposite direction from arrow Y1.

The pushing devices 751, 752 are devices for holding down the lid of the cardboard box 900 in localized fashion. The pushing devices 751, 752 include an upper edge section anchored to the ascending/descending frame 651, a contact section for contacting the lid of the cardboard box 900, and a mover section for moving the heightwise position of the contact section in an ascending/descending direction. The pushing devices 751, 752 are disposed so that the respective contact sections of the pushing devices 751, 752 holds down portions offset from the center of the lid of the cardboard box 900 and which are point-symmetrical with respect to the center (see area PA in FIG. 4).

The transport device 600 is a device for transporting the cardboard box 900 to the cardboard box assembly apparatus 100. The transport device 600 also transports the cardboard box 900 with a lid formed.

The infold-preventing member 700 is a member keeping the four panels of the cardboard box 900 with the lid open, the cardboard box 900 being transported by the transport device 600 to the cardboard box assembly apparatus 100. Specifically, the infold-preventing member 700 is composed of a slide device 710, a slide section 720, and an infold-preventing plate 740. As mentioned above, the slide device 710 is fastened to the fastening section 650 disposed to the upper side in the heightwise direction of the cardboard box assembly 100. The slide section 720 is a member extendible in a vertical downward direction. The infold-preventing plate 740 is a plate-shaped member attached to the distal end of the slide section 720. When the slide section 720 extends downward, the infold-preventing plate 740 contacts the lid of the cardboard box 900. The details of operation will be discussed below.

Next, the process for forming the interleaved lid of the cardboard box 900 is described with the drawings. FIGS. 13 to 17 are schematic process diagrams describing in detail the operation of the cardboard box assembly apparatus 100.

Figure 18:
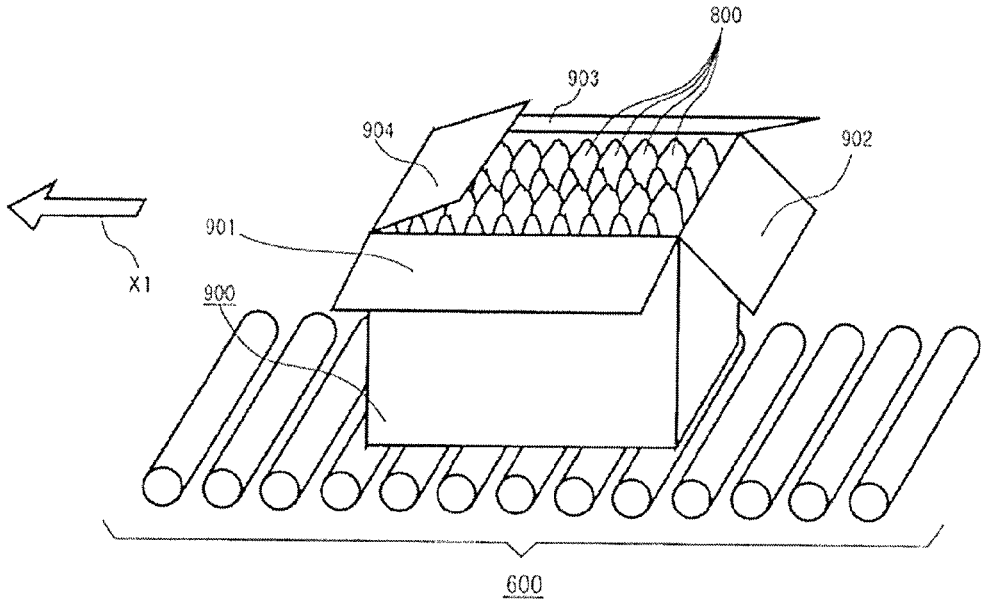
FIG. 18 is a schematic diagram showing the cardboard box in a state immediately prior to being transported into the cardboard box assembly apparatus.
Figure 19:
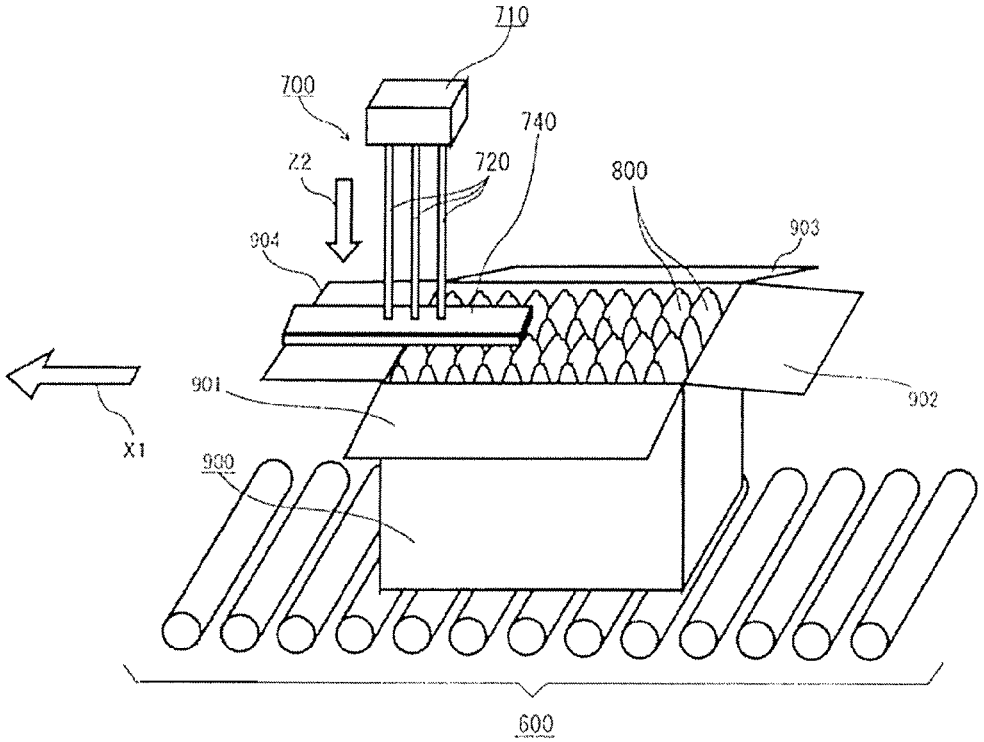
FIG. 19 is a schematic diagram showing the cardboard box in a state immediately prior to being transported into the cardboard box assembly apparatus.

FIGS. 18 and 19 are schematic diagrams describing the cardboard box 900 in a state immediately prior to being transported into the cardboard box assembly apparatus 100. In FIGS. 18 and 19, only the transport device 600 and the infold-preventing member 700 are shown.

Figure 20:
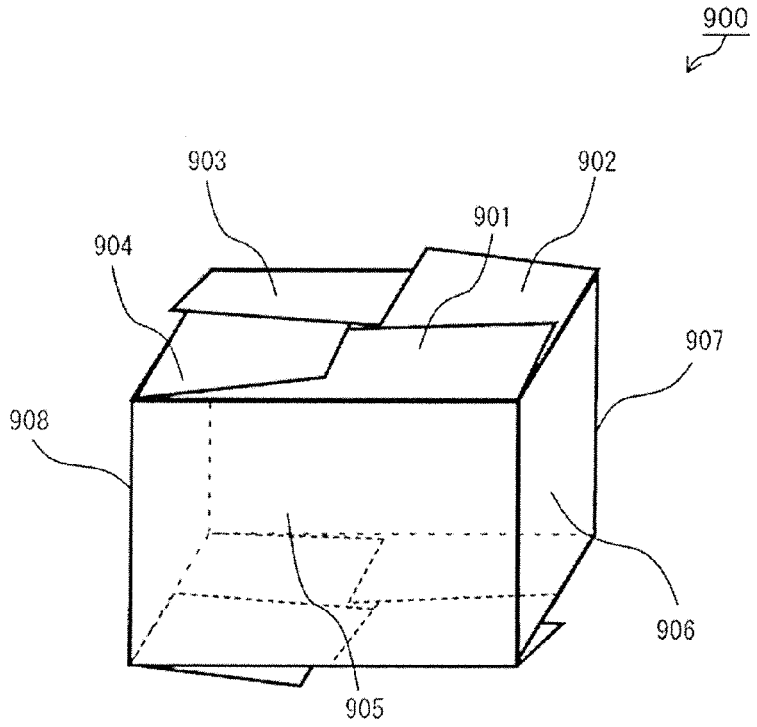
Figure 21:
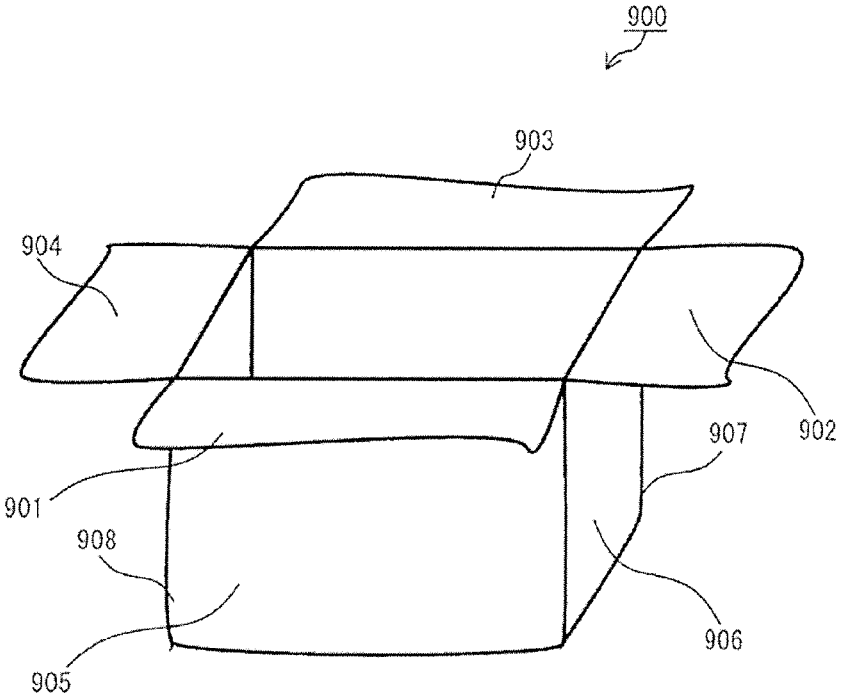
FIG. 21 is a schematic diagram showing an example of a recycled cardboard box.

FIG. 20 is a schematic diagram showing symptoms arising in a case where an interleaved lid has been formed on a new cardboard box 900 or the like. FIG. 21 is a schematic diagram showing an example of a recycled cardboard box 900.

Figure 13:
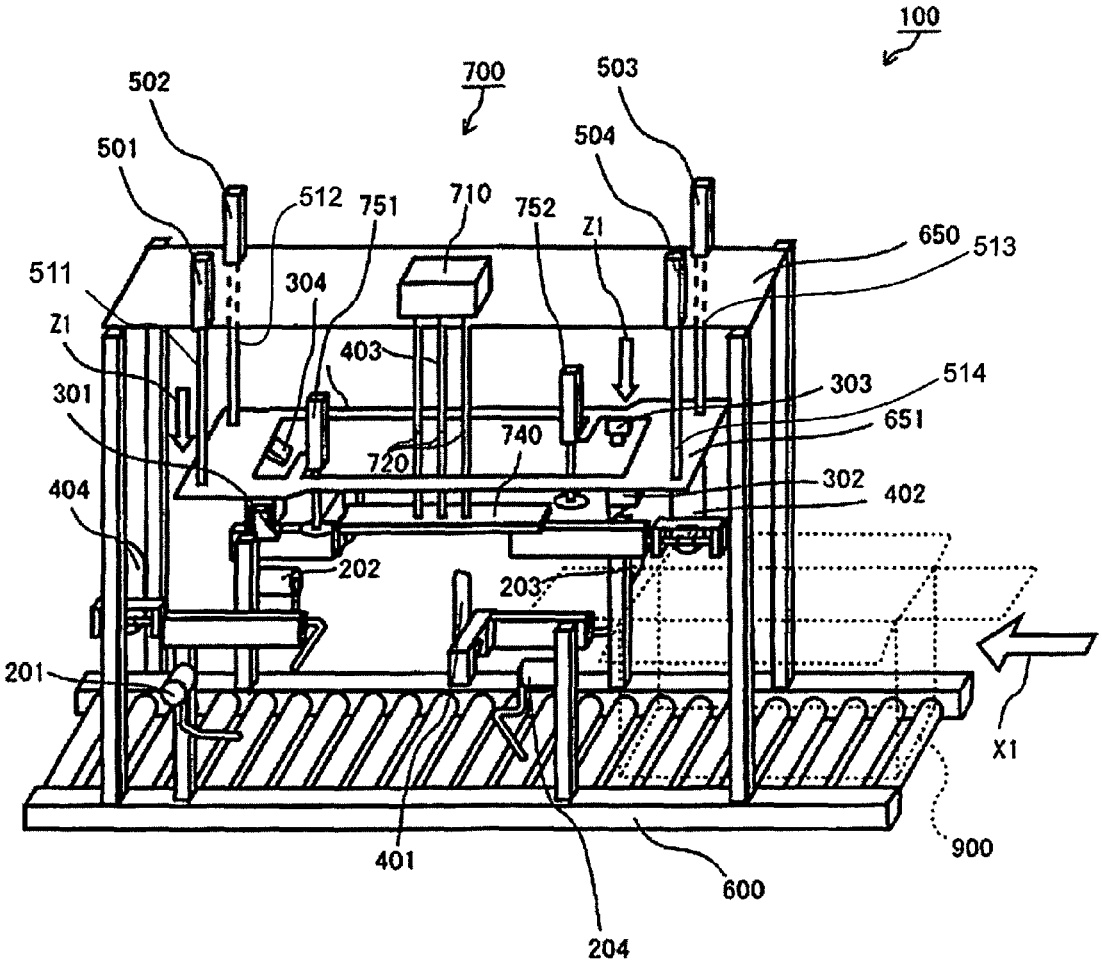
FIG. 13 is a schematic process diagram showing details of the operation of the cardboard box assembly apparatus with the cardboard box shown in phantom entering the apparatus.

First, as shown in FIG. 13, the cardboard box 900 is transported by the transport device 600 to the cardboard box assembly apparatus 100 (in the direction of arrow X1). At this time, the cardboard box 900 is carried in at high speed with the panels 901 to 904 open as shown in FIG. 1. As a result, there arises the problem that, as shown in FIG. 18, owing to the force of air on the panel 902 of the cardboard box 900, a state arises in which the panel 902 is deflected inwardly from the outside. Specifically, the panel 902, which is positioned at the front with respect to the direction of progress of the cardboard box 900, folds in the direction facing the direction of progress.

Accordingly, as shown in FIG. 13, in the cardboard box assembly apparatus 100 of the present embodiment, the extensible rods 511 to 514 of the mover devices 501 to 504 elongate in a vertical downward direction (direction Z1 in the drawing). Simultaneously, with regard to the infold-preventing member 700 which is fastened to the fastening section 650, the slide section 720 extends and the infold-preventing plate 740 moves in a vertical downward direction. In association with the extension of the extensible rods 511 to 514, the ascending/descending frame 651 moves in a vertical downward direction. As a result, the locking members 301 to 304 which are anchored to the ascending/descending frame 651 and the pushing devices 751, 752 move vertically downward.

Figure 14:
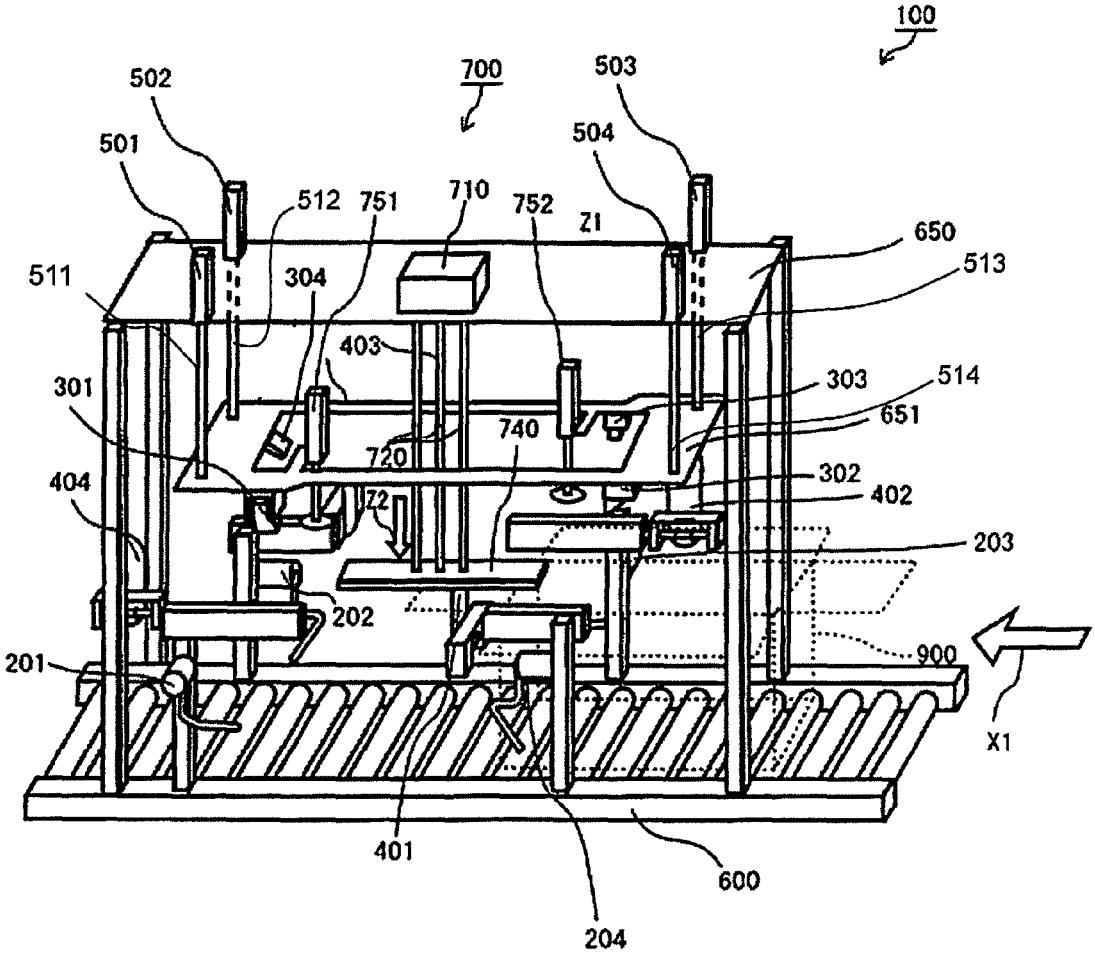
FIG. 14 is a schematic process diagram showing further details of the operation of the cardboard box assembly apparatus with the cardboard box moved partway through the apparatus.

Next, as shown in FIGS. 14 and 19, prior to the cardboard box 900 being carried in at high speed by the transport device 600, a slide section 720 moves further in a vertical downward direction (the direction of arrow Z2). An infold-preventing plate 740 attached to the distal end of the slide section 720 moves in a vertical downward direction in association with the movement of the slide section 720. Specifically, the infold-preventing plate 740 moves to a downward position so that the opened panel 902 of the cardboard box 900 does not fold as shown in FIG. 18.

As a result, the panel 902 is maintained in an opened state, and therefore despite the cardboard box 900 being carried in at high speed, the panel 902 of the cardboard box 900 can be prevented from becoming folded.

Figure 15:
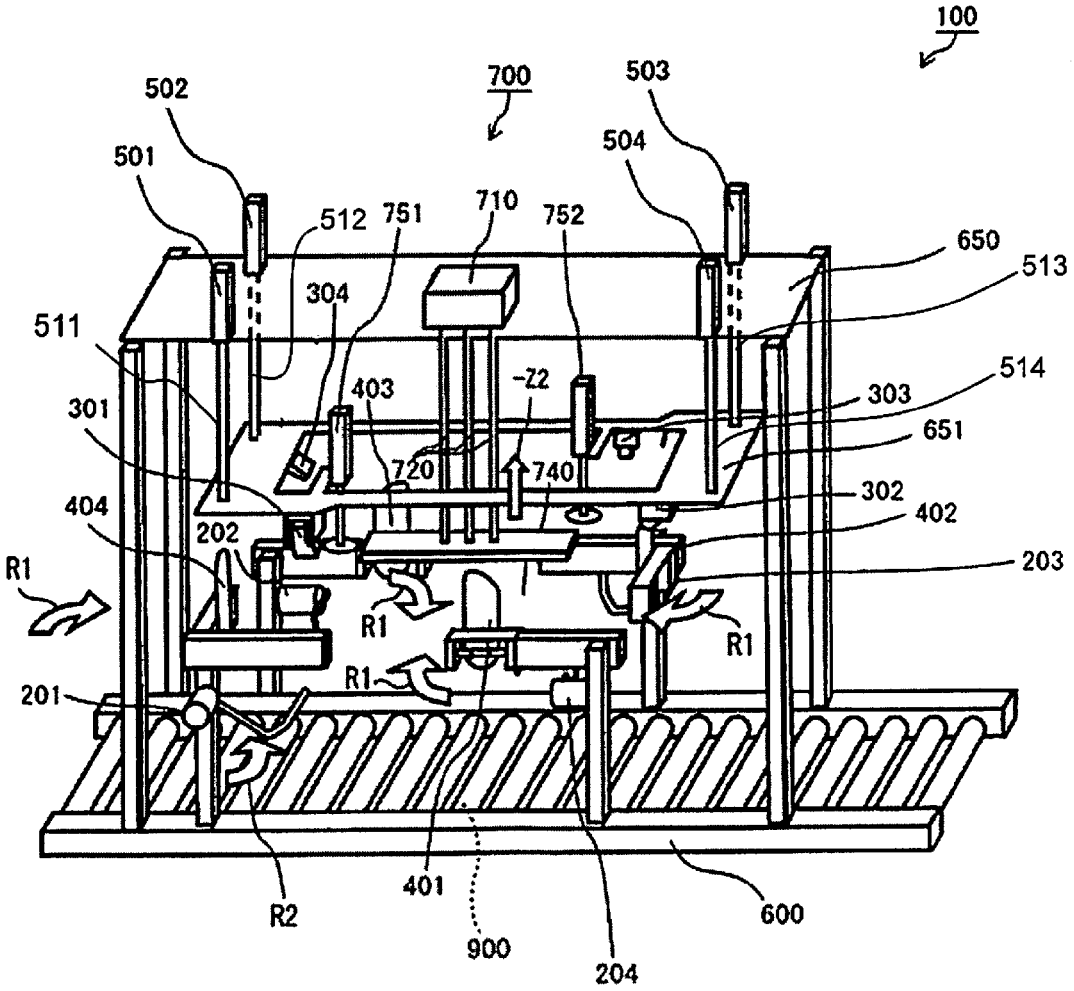
FIG. 15 is a schematic process diagram showing still further details of the operation of the cardboard box assembly apparatus showing the interleaved folding mechanisms moved about a first pivot axis in order to push the lid panels of the cardboard box upward.

Next, as shown in FIG. 15, the slide section 720 moves in a vertical upward direction (the direction of arrow −Z2). In association with the movement of the slide section 720 in a vertical upward direction, the infold-preventing plate 740 moves in a vertical upward direction. Thereafter, operation of the lid erection devices 201 to 204 commences.

The motors 221, 222, 223, 224 of the lid erection devices 201 to 204 rotate in the direction of arrow R2. In association with rotation of the motors 221, 222, 223, 224, the rod members 211, 212, 213, 214 rotate as well. The distal ends of the rod members 211, 212, 213, 214 rotate in the direction of arrow R2 through rotation of the rod members 211, 212, 213, 214. Specifically, the distal ends of the rod members 211, 212, 213, 214 rotate so as to move in a heightwise direction from the lower side to the upper side of the side walls 905, 906, 907, 908. At this time, the distal ends of the rod members 211, 212, 213, 214 move along the side walls 905, 906, 907, 908. Through this movement of the distal ends of the rod members 211, 212, 213, 214 in the heightwise direction from the lower side to the upper side of the side walls 905, 906, 907, 908, the panels 901 to 904 (not shown in the drawing) of the cardboard box 900 respectively assume an erect posture, with edge portions (second edge portions) of the panels 901 to 904 locked by the locking members 301, 302, 303, 304.

Thereafter, the driving mechanisms 421, 422, 423, 424 of the interleaved folding mechanisms 401 to 404 respectively rotate in the direction of arrow R1. Specifically, the driving mechanisms 421, 422, 423, 424 bring about movement of the flat plates 411, 412, 413, 414 from the first planar position to the second planar position. With further driving of the driving mechanisms 421, 422, 423, 424, the flat plates 411, 412, 413, 414 respectively begin to rotate by a given angle towards the inside of the cardboard box 900. For example, the rotation angle of the flat plates 411, 412, 413, 414 with respect to a vertical plane is preferably 1 degree or more, more preferably from 10 to 60 degrees, and still more preferably from 5 to 15 degrees. The angle in question will be discussed below. At this time, the flat plates 411, 412, 413, 414 contacts one side end (a first edge section) of the panels 901 to 904. On the other hand, another side end (a second edge section) of the panels 901 to 904 is held by the locking members 301, 302, 303, 304.

Figure 16:
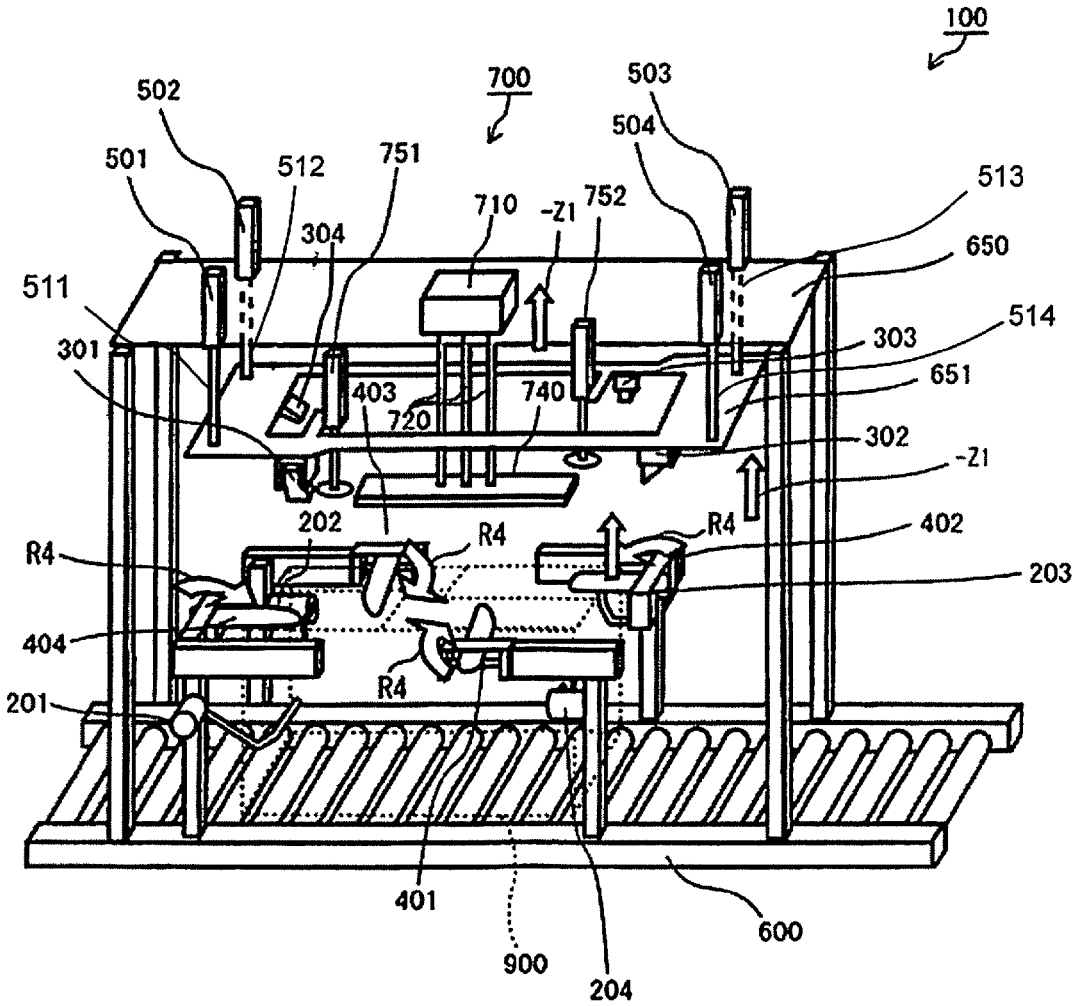
FIG. 16 is a schematic process diagram showing still further details of the operation of the cardboard box assembly apparatus showing the interleaved folding mechanisms moved about a second pivot axis in order to push the lid panels of the cardboard box to overlap or interleave with one another.

Next, as shown in FIG. 16, the mover devices 501 to 504 move in a vertical upward direction (the direction of arrow −Z1). In association with this movement of the mover devices 501 to 504, the locking member 301, 302, 303, 304 move in a vertical upward direction as well. As a result, the second edge sections of the panels 901 to 904 of the cardboard box 900 experience release simultaneously. The flat plates 411, 412, 413, 414 of the interleaved folding mechanisms 401 to 404 then rotate further towards the inside of the cardboard box 900 (the direction of arrow R4). In other words, the flat plates 411, 412, 413, 414 of the interleaved folding mechanisms 401 to 404 keep to detrude the first edge sections of the panels 901 to 904.

As a result, folding of the panels 901 to 904 at the second edge section is delayed, and the respective second edge sections of the panels 901 to 904 are folded on top of the first edge section of the adjacent panels 901 to 904. In so doing, the cardboard box 900 shown in FIGS. 3 and 4 is closed in an interleaved manner.

Figure 17:
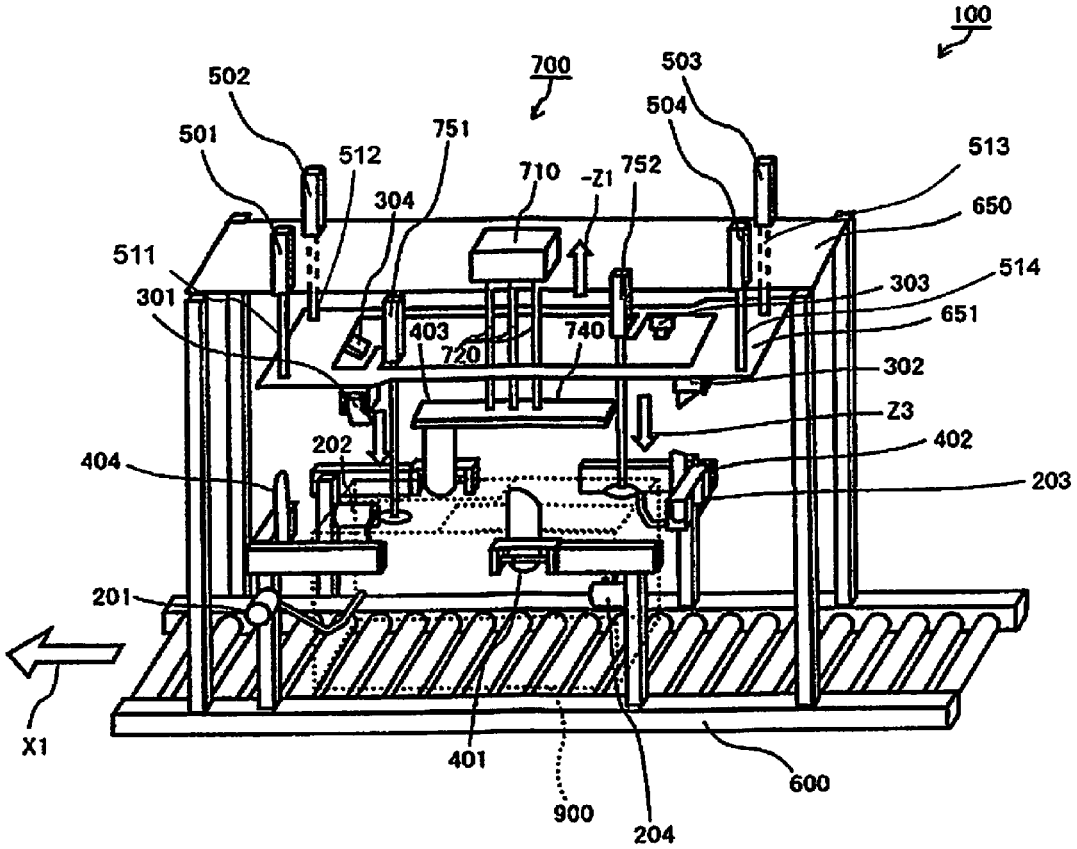
FIG. 17 is a schematic process diagram showing the interleaved folding mechanism of the cardboard box assembly apparatus partially retracted with pushing devices moved downward contacting the interleaved lid panels of the cardboard box.

Further, as shown in FIG. 17, the driving mechanisms 421, 422, 423, 424 of the interleaved folding mechanisms 401 to 404 respectively move in the opposite direction from arrow R1 (see FIG. 15). Specifically, the driving mechanisms 421, 422, 423, 424 cause the flat plates 411, 412, 413, 414 to move respectively from the second planar position to the first planar position. Also, the pushing devices 751, 752 elongate in a vertical downward direction (the direction of arrow Z3) and push the area PA shown in FIG. 4 vertically downward. As a result, the interleaved lid can be prevented from opening automatically, and the cardboard box 900, which has a height equal to or greater than the prescribed height shown in FIG. 20, can be corrected to a given height.

Also, as shown in FIG. 21, even where the cardboard box 900 is recycled multiple times and the panels 901 to 940 have become bent, once the panels 901 to 904 are locked by the contact surfaces 320SU of the locking members 301, 302, 303, 304 having a large rectangular surface area, the locking members 301, 302, 303, 304 simultaneously move vertically upward and release locking of the panels 901 to 904, whereby the timing of folding of the panels 901 to 904 at the respective second edge section thereof can be reliably retarded, so an interleaved lid can be formed.

Figure 22:
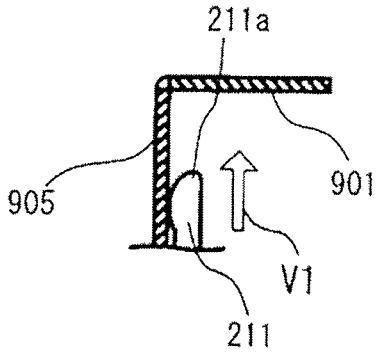
FIG. 22 is a schematic cross-sectional view showing one of the lid erection devices in a retracted position.
Figure 23:
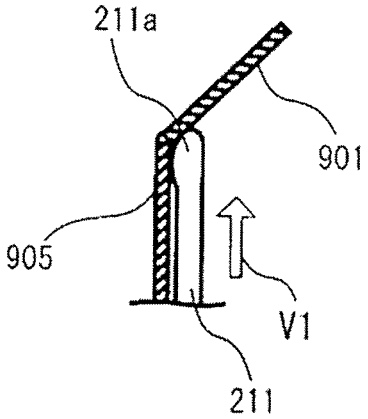
FIG. 23 is a schematic cross-sectional view showing one of lid erection devices moved part-way upward toward an extended position, beginning to push one of the lid panels into an upright orientation.
Figure 24:
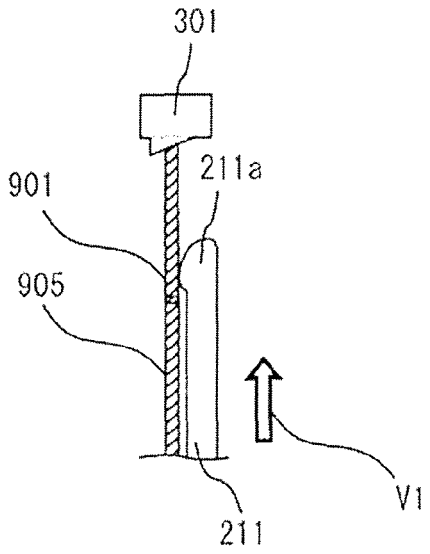
FIG. 24 is a schematic cross-sectional view showing the one of lid erection devices moved to the extended position with the lid panel now in the upright orientation and further showing interaction with one of the locking members.

FIGS. 22 to 24 are schematic cross-sectional views describing operation of the lid erection devices 201 to 204. In FIGS. 22 to 24, the description takes the example of the lid erection device 201.

As shown in FIG. 22, the rod member 211 moves along the side wall 905 of the cardboard box 900 in the direction of arrow V1 from the outside of the side wall 905. In other words, the rod member 211*a* moves along the side wall 905, and towards the upper side in the heightwise direction of the side wall. In the cardboard box 900 in FIG. 22, the panel 901 is opened outwardly as shown in FIG. 1.

Next, as shown in FIG. 23, the rod member 211 moves further towards the direction of arrow V1 along the side wall 905 of the cardboard box 900. Specifically, the rod member 211*a* moves along the side wall 905, and further towards the upper side in the heightwise direction of the side wall. In so doing, in the panel 901, a distal end section 211*a* of the rod member 211 comes into contact with the panel 901, and starts to erect the panel 901. In this case, the distal end section 211*a* will be formed to a shape whereby the panel 901 of the cardboard box 900 may be erected smoothly, without damage to the panel 901.

Finally, as shown in FIG. 24, the rod member 211 moves further towards the direction of arrow V1 along the side wall 905 and the panel 901 of the cardboard box 900. Specifically, the rod member 211*a* moves along the side wall 905, and further towards the upper side in the heightwise direction of the side wall. In so doing, the panel 901 assumes an erect posture, with the second edge section of the panel 901 locked by the locking member 301.

Figure 25:
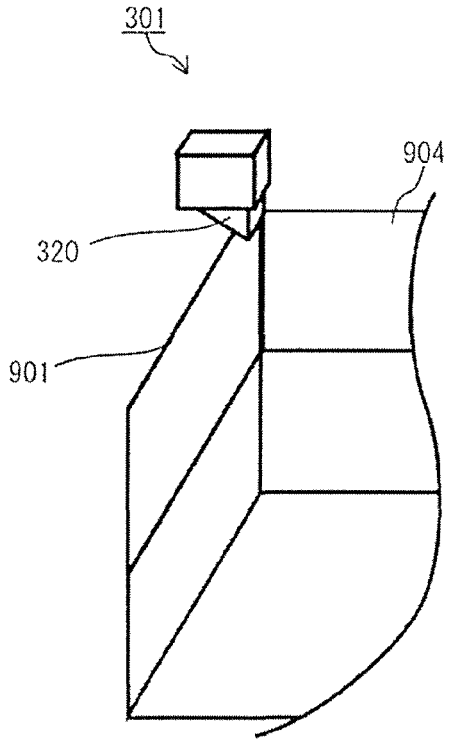
FIG. 25 is a schematic overview diagram showing operation of the locking member.
Figure 26:
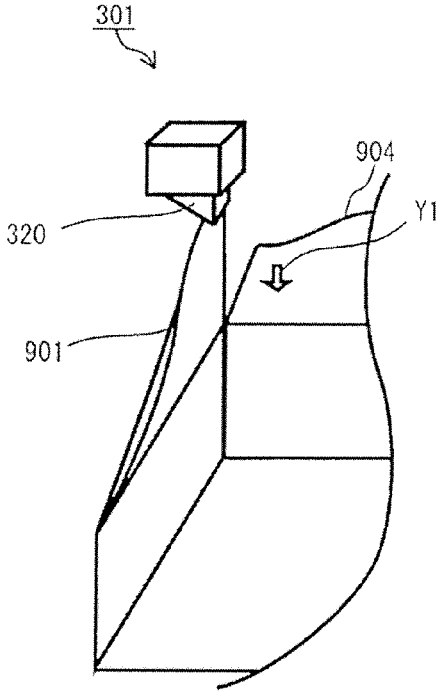
FIG. 26 is a schematic overview diagram showing operation of the locking member.
Figure 27:
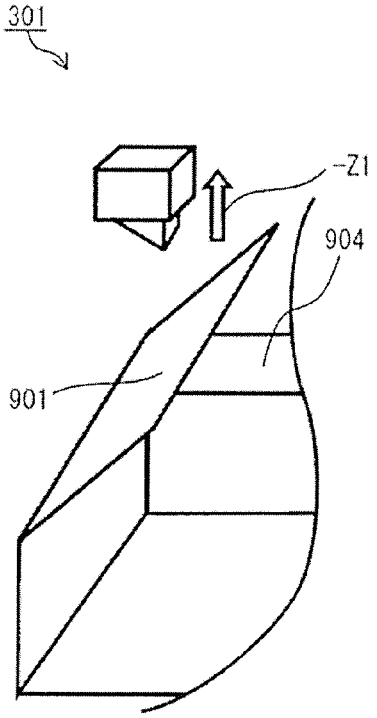
FIG. 27 is a schematic overview diagram showing the locking member releasing the lid panel.

Next, the details of operation of the locking members 301 to 304 are described with FIGS. 25 to 27. The description in FIGS. 25 to 27 takes the example of the locking member 301. FIGS. 25 to 27 are schematic overview diagrams describing an example of operation of a locking member 301.

As shown in FIG. 25, the locking member 301 holds a second edge section (an edge section of the area AR13) of the panel 901 of the cardboard box 900 with the contact surface 320SU of the movable section 320. Specifically, the panel 901 is held through contact of the contact surface 320SU with the edge section of the area AR13 of the panel 901. Next, as shown in FIG. 26, a first edge section of the panel 901 begins to be detruded towards the inside of the cardboard box 900. The first edge section refers to an area positioned to the opposite side of the area AR13 in the widthwise direction of the panel 901, specifically, the area AR11. The area AR11 of the panel 901 is detruded by the flat plate 411 of the interleaved folding mechanism 401. At the same time, the area AR11 of the panel 904 adjacent to the panel 901 begins to undergo detrusion towards the direction of arrow Y1. The direction of arrow Y1 refers to the inside direction of the cardboard box 900, which is the direction of lid closure.

Finally, as shown in FIG. 27, in association with movement of the mover devices 501 to 504 in a vertical upward direction (the direction of arrow −Z1), the locking member 301 moves in the vertical upward direction as well. As a result, the contact surface 320SU separates from the area AR13 of the panel 901. Once the contact surface 320SU is separated from the area AR13 of the panel 901, owing to the force applied in the area AR11 of the panel 901 by the flat plate 411 of the interleaved folding mechanism 401, the area AR13 of the panel 901 is also bent in the direction of closure of the lid. Because the area AR13 of the panel 901 is bent later than the area AR11, the area AR11 of the panel 904 is disposed below the area AR13 of the panel 901. The locking members 302 to 304 simultaneously move in a vertical upward direction in the same manner as the locking member 301, and therefore the areas AR11 of the panel 902, the panel 903, and the panel 904 are disposed below the areas AR13 of adjacent panels.

Continuing on, FIGS. 28 to 33 are schematic cross-sectional views describing operation of the interleaved folding mechanisms 401 to 404. In FIGS. 28 to 33, the interleaved folding mechanism 401 is shown as an example of the interleaved folding mechanisms 401 to 404.

Figure 28:
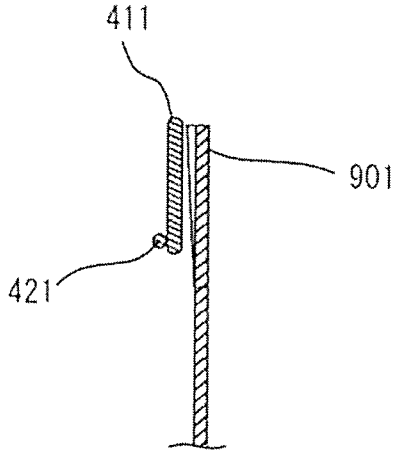
FIG. 28 is a schematic cross-sectional view showing operation of one of the interleaved folding mechanisms moved to the position depicted in FIG. 15.
Figure 29:
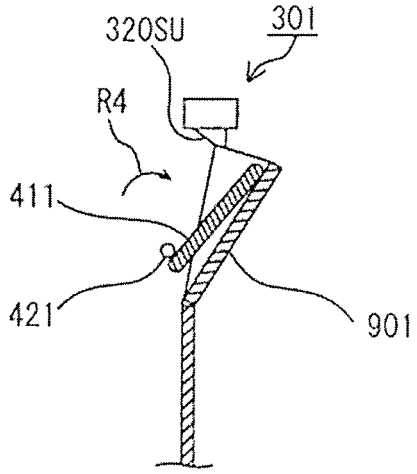
FIG. 29 is a schematic cross-sectional view showing operation of the one of the interleaved folding mechanisms pivoting about the second axis and beginning to move from the position shown in FIG. 15 toward the position shown in FIG. 16.

First, the flat plate 411 of the interleaved folding mechanism 401 moves from the first planar position to the second planar position, and the center section of the flat plate 411 contacts with the panel 901 from the outside, as shown in FIG. 28. Next, as shown in FIG. 29, the driving mechanism 421 rotates, rotating the flat plate 411 in the direction of arrow R4. In so doing, the one side end (the first edge section) of the panel 901 begins to undergo detrusion towards the inside of the cardboard box 900. In this state, another side end (the second edge section) of the panel 901 is held in contact with the contact surface 320SU of the locking member 301.

Figure 30:
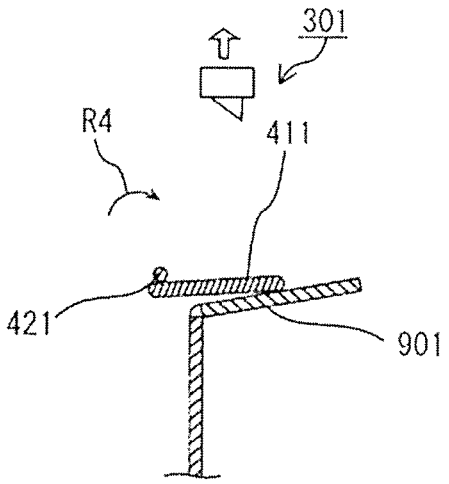
FIG. 30 is a schematic cross-sectional view showing operation of the one of the interleaved folding mechanisms shown pivoting about the second axis closer to the position shown in FIG. 16.

Next, as shown in FIG. 30, the locking member 301 moves vertically upward. Also, the driving mechanism 421 rotates further, rotating the flat plate 411 in the direction of arrow R4. In so doing, the first edge section of the panel 901 continues to undergo detrusion towards the inside of the cardboard box 900.

Figure 31:
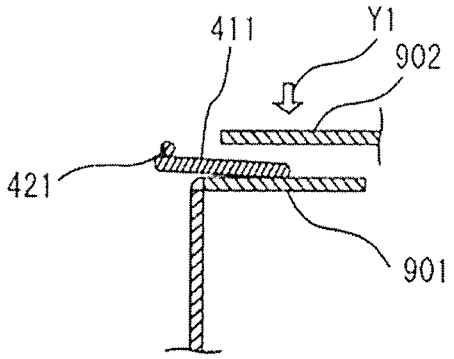
FIG. 31 is a schematic cross-sectional view showing operation of the one of the interleaved folding mechanisms shown in the position shown in FIG. 16.
Figure 32:
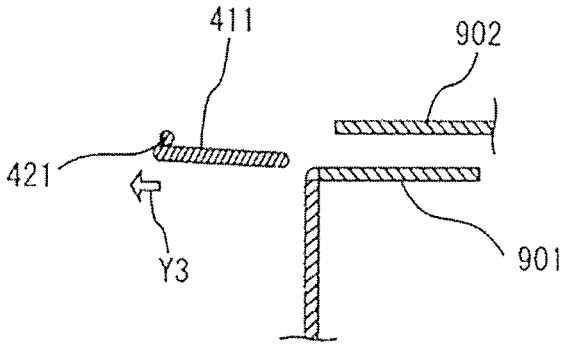
FIG. 32 is a schematic cross-sectional view showing operation of the one of the interleaved folding mechanisms shown slightly moved away from the cardboard box in movement about the first pivot axis.
Figure 33:
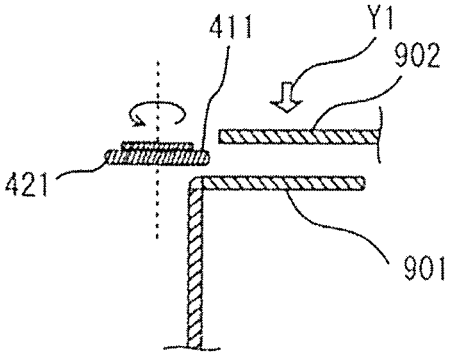
FIG. 33 is a schematic cross-sectional view showing operation of the one of the interleaved folding mechanisms shown moved further away from the cardboard box in movement about the first pivot axis.

Next, as shown in FIG. 31, the second edge section of the panel 902 is detruded in the direction of arrow Y1. Here, the direction of arrow Y1 refers to the detrusion direction. At this time, the flat plate 411 is tucked between the second edge section of the panel 902 and the first edge section of the panel 901. Thus, the driving mechanism 421 moves horizontally in the direction of arrow Y3 as shown in FIG. 32. Here, the direction of arrow Y3 refers to a direction of separation from the cardboard box 900. In so doing, the flat plate 411 is withdrawn from between the second edge section of the panel 902 and the first edge section of the panel 901. Alternatively, the driving mechanism 421 may bring about rotating movement of the flat plate 411 centered on vertical axis as shown in FIG. 33, instead of FIG. 32. In other words, the driving mechanism 421 may bring about 90° rotation of the flat plate 411 within a horizontal plane. In such cases as well, the flat plate 411 is withdrawn from between the second edge section of the panel 902 and the first edge section of the panel 901.

Through the preceding, the panels 901, 902, 903, 904 of the cardboard box 900 can be assembled into an interleaved lid in a reliable manner.

Figure 34:
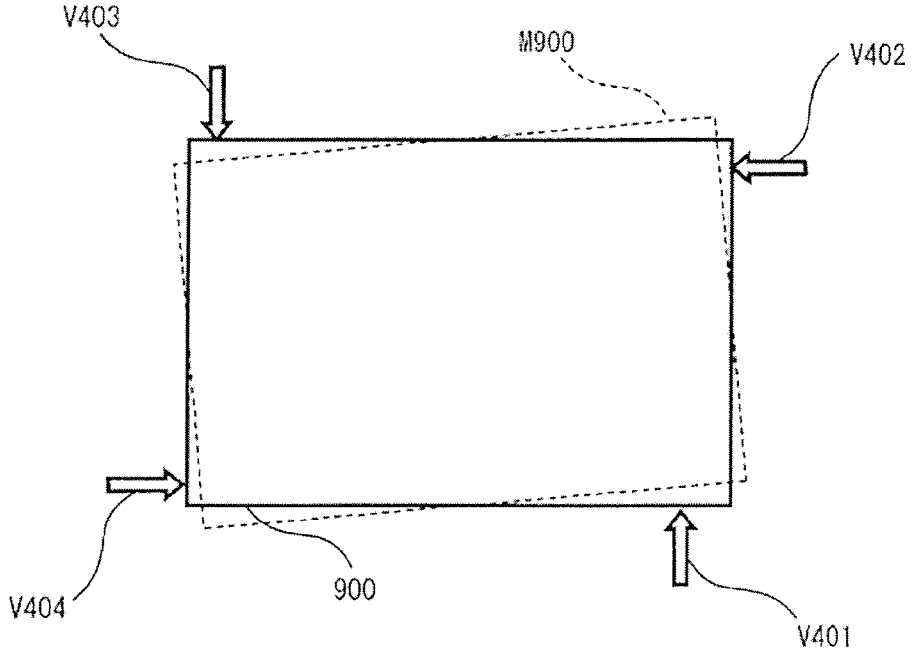
FIG. 34 is a schematic diagram showing effects on the cardboard box assembly apparatus provided with lid erection devices.

Next, with reference to FIGS. 34 and 35, the effect of cardboard box assembly apparatus 100 provided with the lid erection devices 201 to 204 will be described. FIG. 34 is a schematic diagram of a case where the lid erection devices 201 to 204 are not provided, and FIG. 35 is a schematic diagram of a case where the lid erection devices 201 to 204 according to the present invention are provided.

As shown in FIG. 34, in a case where the lid erection devices 201 to 204 are not provided, instead providing only the interleaved folding mechanisms 401 to 404, only forces V401, V402, V403, and V404 are applied to the cardboard box 900. The forces V401, V402, V403, and V404 are respectively applied by the flat plates 411, 412, 413, and 414 of the interleaved folding mechanisms 401 to 404. Specifically, the forces V401, V402, V403, and V404 are brought to bear on a single widthwise edge of the side walls 905, 906, 907, 908 of the cardboard box 900. In other words, in plan view, leftward-rotating force around the center of the cardboard box 900 is applied to the cardboard box 900. As a result, the cardboard box 900 deforms as shown by the broken lines M900. Specifically, forces tending to fold the panels 901 to 904 are dissipated in the direction shown by the broken lines M900, and part of the forces V401, V402, V403, and V404 is wasted.

Figure 35:
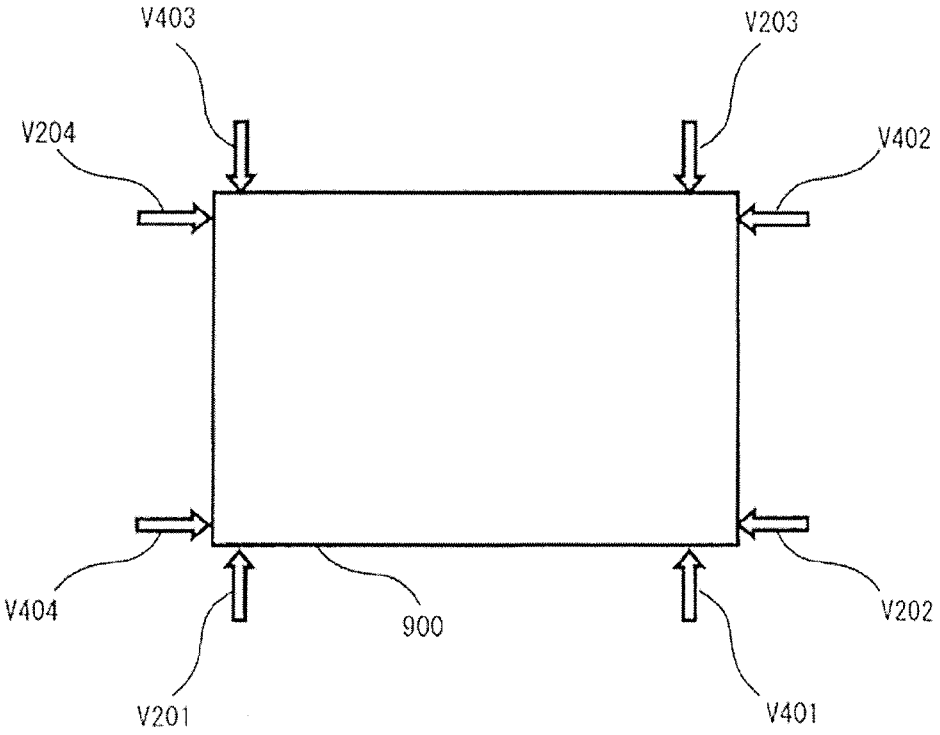
FIG. 35 is a schematic diagram showing effects on cardboard box assembly apparatus provided with lid erection devices.

On the other hand, where both the lid erection devices 201 to 204 and the interleaved folding mechanisms 401 to 404 have been provided, as shown in FIG. 35, the forces V401, V402, V403, and V404, as well as forces V201, V202, V203, and V204, are applied to the cardboard box 900. The forces V401, V402, V403, and V404 are applied by the flat plates 411, 412, 413, and 414 of the interleaved folding mechanisms 401 to 404. The forces V201, V202, V203, and V204 are applied by the rod members 211, 212, 213, 214 of the lid erection device 200.

Specifically, the forces V401 to V404 and the forces V201 to V204 bear on both widthwise edges of the side walls 905, 906, 907, 908 of the cardboard box 900. In other words, forces bear on both portions of the side walls 905, 906, 907, 908 (side wall edge sections) respectively constituting the four corners of the cardboard box 900. In this case, the force V401 applied to the panel 901 of the cardboard box 900 is supported by the force V203, the force V402 applied to the panel 902 of the cardboard box 900 is supported by the force V204, the force V403 applied to the panel 903 of the cardboard box 900 is supported by the force V201, and the force V404 applied to the panel 904 of the cardboard box 900 is supported by the force V202.

Accordingly, in this case, deformation of the cardboard box 900 does not arise. Specifically, forces tending to fold the panels 901 to 904 are not dissipated in the direction shown by the broken lines M900, and the lid of the cardboard box 900 can be closed in an interleaved manner with a minimum of the forces V401, V402, V403, and V404.

Modification Example A

Figure 36:
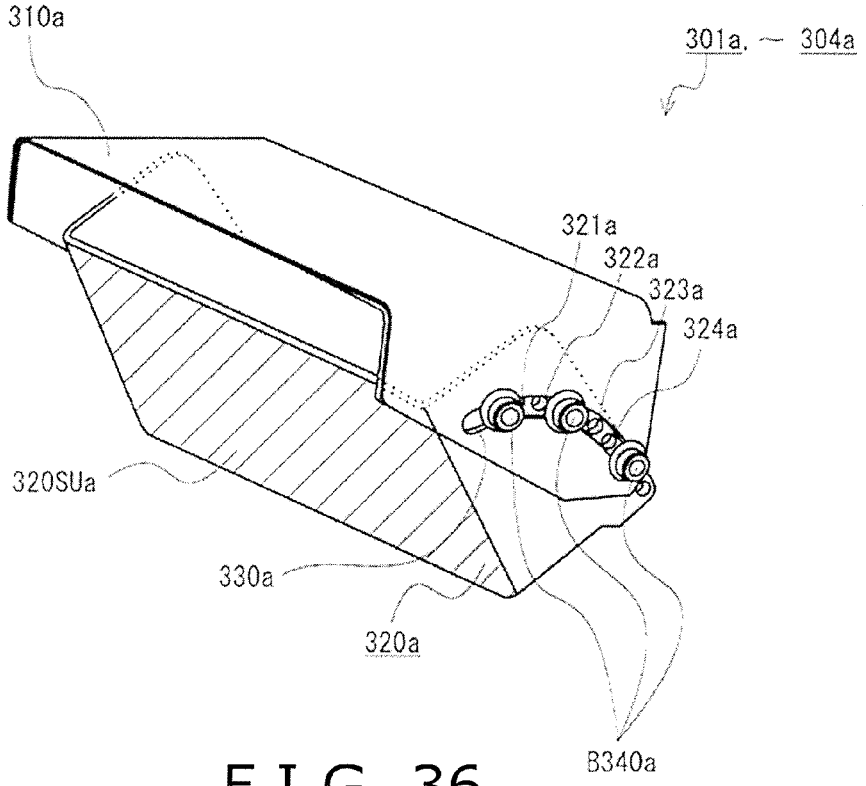
FIG. 36 is a schematic diagram showing another example of locking members.
Figure 37:
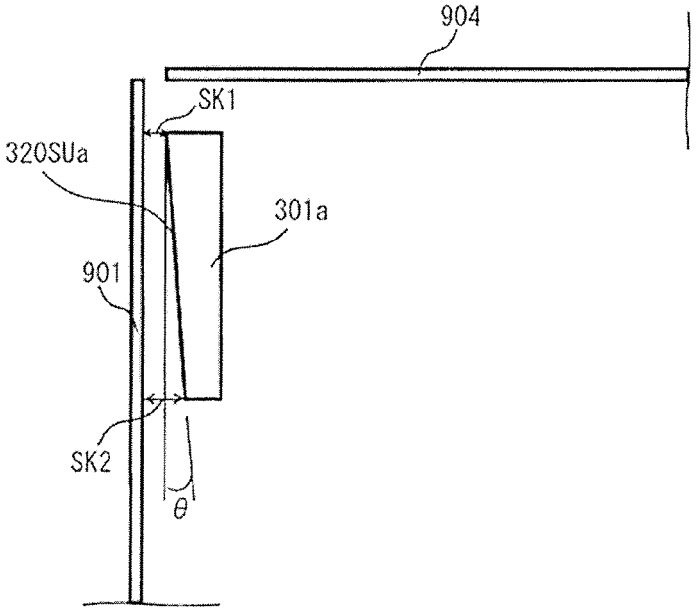
FIG. 37 is a schematic diagram showing the another example of locking members and a relationship with lid panels of a cardboard box.

Next, another example of the locking members 301 to 304 will be described. FIGS. 36 and 37 are schematic diagrams describing another example of the locking members 301 to 304.

The locking members 301*a* to 304*a* shown in FIG. 36 have a contact surface 320SUa with a larger surface area than the contact surface 320SU of the locking members 301 to 304 of FIG. 9.

As shown in FIG. 37, the contact surface 320SUa may be inclined with respect to a vertical plane such that a gap SK2 situated closer to the first edge section of the cardboard box 900, specifically, closer to the interleaved folding mechanism 401, is greater than a gap SK1 situated further away from the interleaved folding mechanism 401. In the concrete, the contact surface 320SUa is furnished inclined with respect to a vertical plane by an angle θ (40 degrees or less, preferably in a range of from 1 to 35 degrees, more preferably in a range of from 5 to 25 degrees, and still more preferably in a range of from 15 to 30 degrees).

As a result, when the panel 901 of the cardboard box 900 is pushed in the folding direction (the detrusion direction) (direction of arrow R4), the occurrence of creasing, which tends to arise in the areas AR11 to AR13 of the panel 901, can be prevented (see FIG. 29).

Modification Example B

Whereas the aforedescribed embodiment used the flat plates 411 to 414 of the interleaved folding mechanisms 401, 402, 403, 404, there is no limitation thereto, and other pushing devices for folding the lid of the cardboard box 900, such as a curved plate, a projecting rod member, or the like are also acceptable.

Whereas the locking members 301 to 304 are moved vertically upward by the mover devices 501 to 504 in the aforedescribed embodiment, there is no limitation thereto, and the members may be moved diagonally upward, or the lower edge sections of the locking members 301 to 304 may be moved in a direction including a vertical component. Specifically, new rotating devices (rotation mechanism) may be furnished, and the panels 901 to 904 may be released from retention through rotation of the locking members 301 to 304.

The transport device 600 is not limited to rotating rollers, and other transport mechanisms, such as a belt conveyor or the like, are also acceptable.

Whereas the aforedescribed embodiment employed the mover devices 501 to 504, there is no limitation thereto, and a single mover device, or two mover devices, may be employed instead.

While the locking members 301 to 304 employ a flat surface as the contact surface 320SU, there is no limitation thereto, and other shapes are acceptable as well. For example, a curved surface is acceptable, as are a plurality of contact surfaces.

Further, while it is not necessary for the entire contact surface 320SU to be in contact with the flat plates 411, 412, 413, 414, contact over a range in a vertical upward direction from the center section of the contact surface 320SU is preferred. Contact over a range in a vertical downward direction from the center section of the contact surface 320SU is acceptable as well.

Modification Example C

Figure 38:
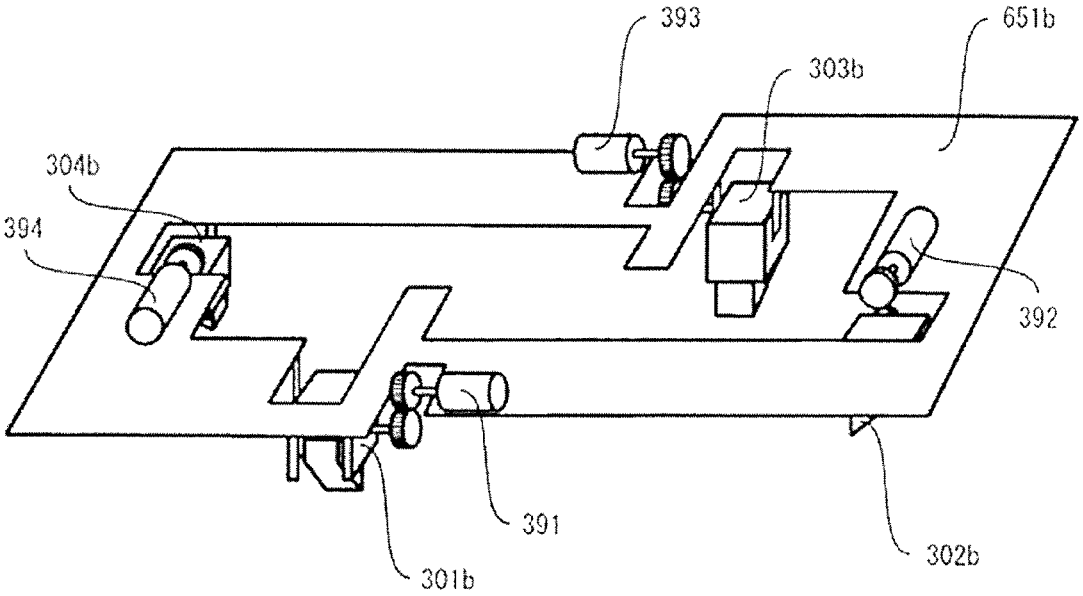
FIG. 38 is a schematic diagram showing yet another example of locking members.
Figure 39:
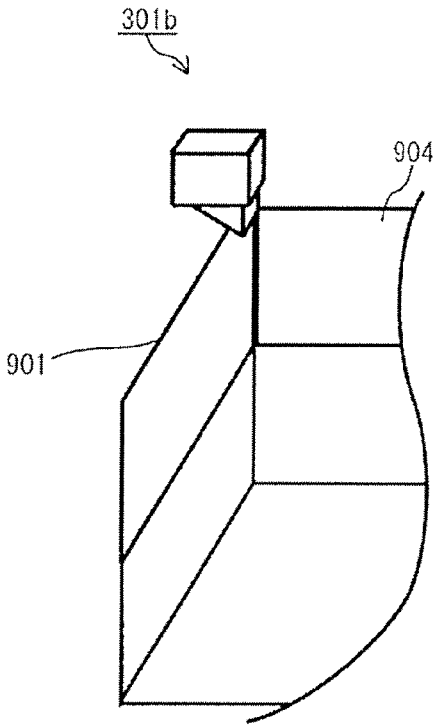
FIG. 39 is a schematic diagram showing the yet another example of the locking members in FIG. 38, and showing a contacting relationship with lid panels of the cardboard box.
Figure 40:
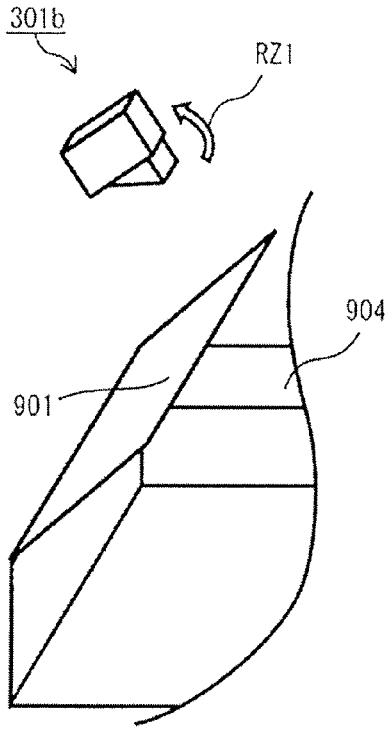
FIG. 40 is a schematic diagram showing the yet another example of the locking members shown in FIGS. 38 and 39, with the locking members releasing the lid panel of the cardboard box.

FIGS. 38, 39, and 40 are schematic diagrams describing another example of the locking members 310 to 304.

As shown in FIG. 38, an ascending/descending frame 651*b* may be furnished in place of the ascending/descending frame 651 of the cardboard box assembly apparatus 100 shown in FIG. 8.

Motors 391 to 394 (rotation mechanism) are furnished on the vertical upper face of the ascending/descending frame 651*b*. The motors 391 to 394 are connected via gears to locking members 301*b* to 304*b*. Accordingly, as shown in FIGS. 39 and 40, the locking members 301*b* to 304*b* can be rotated in the direction of arrow RZ1 through rotation of the motors 391 to 394. In other words, through rotation of the motors 391 to 394, the flat surface portion of the fastening section 310 of the locking members 301*b* to 304*b* tilt towards a perpendicular direction. As a result, the lower edges of the contact surfaces of the locking members 301*b* to 304*b* move in a vertical upward direction, releasing the panels 901 to 904.

The contact surfaces 320SU which contact the panels 901 to 904 show high rigidity. Because of this, the contact surfaces 320SU firmly support the panels 901 to 904, and the timing of release of the panels 901 to 904 can be controlled in a reliable manner. As a result, an interleaved lid can be formed on the cardboard box 900 in a reliable manner.

The locking members 301*b* to 304*b* may be moved in a vertical upward direction (the direction of arrow −Z1) by the mover devices 501 to 504, while being rotated in the direction of arrow RZ1 by the motors 391 to 394.

As shown in FIG. 25, the edge section of the area AR13 of the panel 901 of the cardboard box 900 is held by the contact surface 320SU of the movable section 320 of the locking member 301. Continuing on, as shown in FIG. 26, the area AR11 of the panel 901 begins to undergo detrusion towards the inside of the cardboard box 900 by the flat plate 411 of the interleaved folding mechanism 401. Simultaneously, the area AR11 of the panel 904 adjacent to the panel 901 begins to undergo detrusion towards the direction of arrow Y1 (the direction of closure).

Finally, as shown in FIG. 27, the locking member 301 is moved in a vertical upward direction (the direction of arrow −Z1) by the mover devices 501 to 504. As a result, the area AR13 of the panel 901 separates from the contact surface 320SU, and the area AR11 of the panel 901 is pushed by the flat plate 411 of the interleaved folding mechanism 401. In so doing, the area AR11 of the panel 904 is disposed below the area AR13 of the panel 901. The locking member 301 and the locking members 302 to 304, simultaneously move in a vertical upward direction, and therefore each area AR13 of the panel 902, the panel 903, and the panel 904, becomes disposed above the areas AR11 of adjacent panels.

Modification Example D

Figure 41:
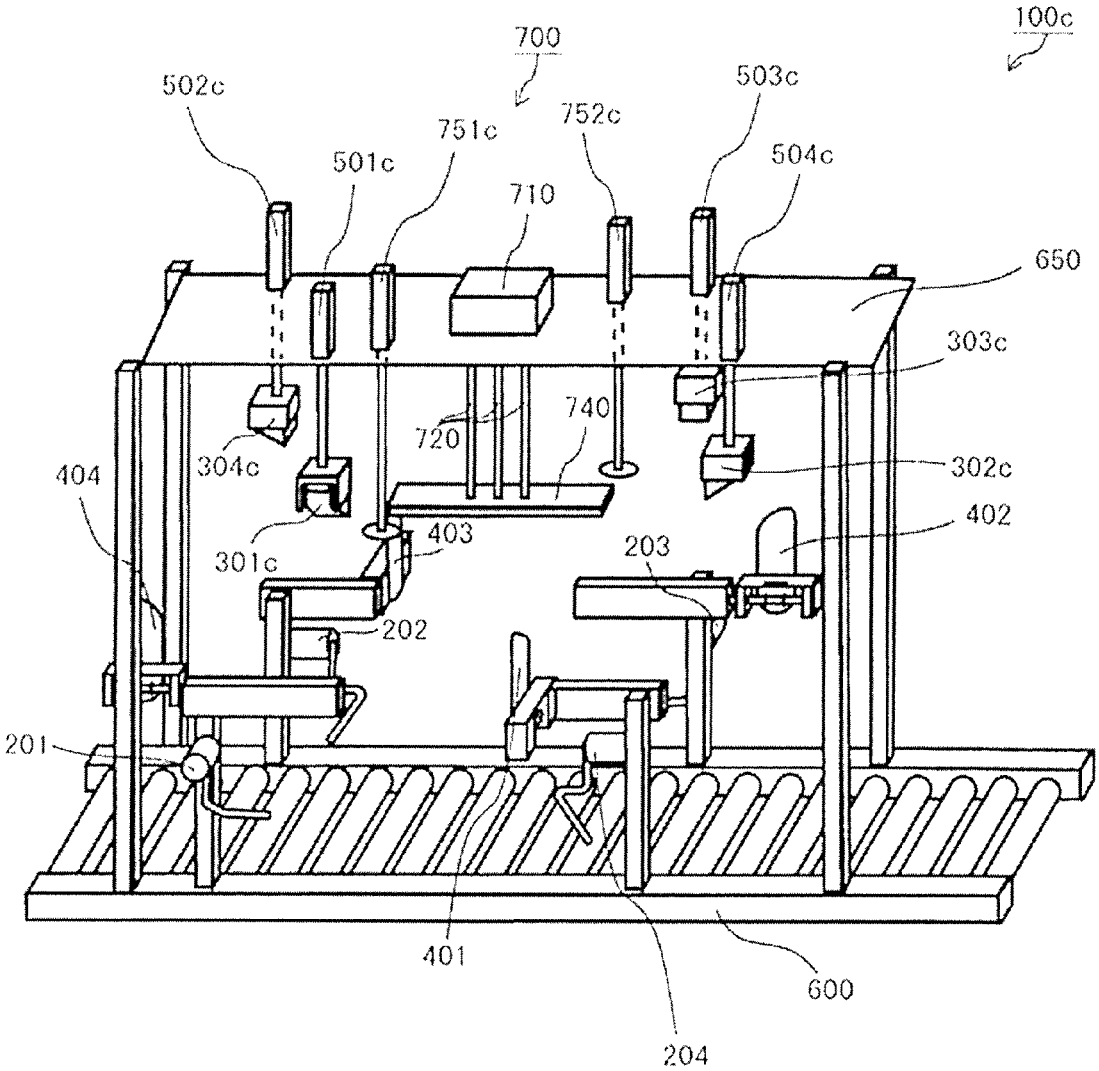
FIG. 41 is a schematic overview diagram showing still another example of mover devices and locking members.

FIG. 41 is a schematic exterior view showing another example of mover devices and locking members.

Cardboard box assembly apparatus 100*c* shown in FIG. 41 differs from the cardboard box assembly apparatus 100 in that it includes locking members 301*c* to 304*c*, mover devices 501*c* to 504*c*, and pushing devices 751*c* and 752*c*.

As shown in FIG. 41, in the cardboard box assembly apparatus 100*c*, the locking member 301*c* is furnished at the lower edge of the mover device 501*c*, the locking member 302*c* is furnished at the lower edge of the mover device 502*c*, the locking member 303*c* is furnished at the lower edge of the mover device 503*c*, and the locking member 304*c* is furnished at the lower edge of the mover device 504*c*.

Accordingly, ascent and descent of the locking members 301*c* to 304*c* can be separately controlled through independent operation of the mover devices 501*c* to 504*c*. As a result, specialty shapes for the cardboard box 900 can be accommodated.

The pushing devices 751*c*, 752*c* are arranged on the upper face of the fastening section 650.

The present embodiment described employing the motors 221 to 224 as an example of the various driving sections. However, the various driving sections are not limited to motors, and other driving devices, for example, rotary air cylinders, other air cylinders, hydraulic devices, or the like, are acceptable as well.

As shown hereinabove, in the cardboard box assembly apparatus 100 according to the present embodiment, the locking members 301 to 304 or 301*a* to 304*a* lock the panels 901 to 904 at second edge section, while the interleaved folding mechanisms 401 to 404 push first edge section of the panels 901 to 904 in the folding direction. Accordingly, the timing of detrusion of the second edge sections of the adjacent panels 901 to 904 can be delayed relative to the timing of detrusion of the first edge sections. In so doing, the second edge sections of the panels 901 to 904 can be fold over the first edge sections of the adjacent panels 901 to 904.

Also, the locking members 301 to 304 or 301*a* to 304*a* are disposed at locations for locking the panels 901 to 904 in a reliable manner. The locking members 301 to 304 can be moved in a direction including a vertical upward component by the mover devices 501 to 504. Because of this, an interleaved lid can be formed on the cardboard box 900 in a reliable manner, irrespective of the state of the lid, or whether the cardboard used is a recycled cardboard box 900 or a new cardboard box 900.

Additionally, the locking members 301 to 304 or 301*a* to 304*a* include the contact surfaces 320SU, 320SUa which are inclined downward along the detrusion direction. Because of this, even in cases where the lid section of the cardboard box 900 has become bent through recycling, the downward-inclined contact surfaces 320SU, 320SUa can lock the bent lid in a reliable manner.

Furthermore, the locking members 301 to 304 or 301*a* to 304*a* have an angle adjustment mechanism composed of the fastening section 310, the movable section 320, and the bolts B340. Angle adjustment of the contact surfaces 320SU, 320SUa can be performed according to the size of the cardboard box 900. As a result, cardboard box assembly of various types of cardboard boxes can be accommodated, and the versatility of the cardboard box assembly apparatus 100 can be improved.

Also, the mover devices 501 to 504 hold the locking members 301 to 304 in an integrated manner. In so doing, the locking members 301 to 304 can be simultaneously moved in a vertical upward direction driven by the mover devices 501 to 504. As a result, the plurality of panels 901 to 904 of the cardboard box 900 can be detruded simultaneously, whereby an interleaved lid can be formed in a reliable manner.

Additionally, once the interleaved lid of the cardboard box 900 has been formed, the pushing devices 751, 752 push the lid vertically downward from vertically above. As a result, the interleaved lid of the cardboard box 900 can be prevented from collapsing. Particularly in the case of a new cardboard box, as shown in FIG. 20, the panels 901 to 904 are frequently prone to return in the opposite direction from the detrusion direction. However, because the interleaved lid is held in a reliable manner by the pushing devices 751, 752, collapse of the interleaved lid of the cardboard box 900 can be prevented.

The rod members 211 to 214 are rotated by the lid erection devices 201 to 204, with the rod members 211 to 214 undergoing rotational movement along the side walls (panels 905 to 908) towards the four panels (901 to 904) from the lower side of the side walls. In so doing, the four panels (901 to 904) constituting the lid of the cardboard box 900 can be erected from downward positions to the outside of the side walls (panels 905 to 908) to positions above the side walls. Simultaneously, the lid section can be clamped between the locking members 301 to 304 and the rod members 211 to 214.

In the present invention, the cardboard box 900 corresponds to the cardboard box, and the panels 901, 902, 903, 904 correspond to the four panels constituting the lid section. The cardboard box assembly apparatus 100 corresponds to the cardboard box assembly apparatus. The locking members 301 to 304, 301*a* to 304*a*, and 301*c* to 304*c* correspond to the locking members. The interleaved folding mechanisms 401 to 404 correspond to the detrusion members. The motors 221 to 224 correspond to the rotation devices. The rod members 211 to 214 correspond to the rod members. The motors 391 to 394 correspond to the rotation mechanisms. The mover devices 501 to 504, 501*c* to 504*c*, and the lid erection devices 201 to 204 correspond to the lid erection devices.

The controller (not shown) preferably includes a microcomputer with a control program that controls the cardboard box assembly apparatus 100, as discussed below. The controller can also include other conventional components such as an input interface circuit, an output interface circuit, and storage devices such as a ROM (Read Only Memory) device and a RAM (Random Access Memory) device. The microcomputer of the controller is programmed to control the cardboard box assembly apparatus 100. The controller is operatively coupled to the cardboard box assembly apparatus 100 in a conventional manner. The internal RAM of the controller stores statuses of operational flags and various control data. The controller is capable of selectively controlling any of the components of the cardboard box assembly apparatus 100. It will be apparent to those skilled in the art from this disclosure that the precise structure and algorithms for the controller can be any combination of hardware and software that will carry out the functions of the present invention.

While a preferred embodiment of the present invention has been described above, the present invention is not limited thereto. It should be understood that other various embodiments may be devised without departing from the spirit and the scope of the present invention. Further, whereas actions and effects obtained from the features of the present embodiment of the present invention have been set forth, these actions and effects are exemplary and do not limit the invention.

What is claimed is:

1. A cardboard box assembly apparatus for folding four panels constituting a lid section of a cardboard box to form an interleaved lid such that each of the four panels overlaps with others of the four panels, the cardboard box assembly apparatus comprising:

a frame structure;

a plurality of detruding members attached to the frame structure, each detruding member detruding a first portion of a corresponding one of the four panels in a corresponding detrusion direction;

a plurality of locking members, each locking member locking a second portion of the corresponding one of the four panels in response to the corresponding detruding member detruding the first portion of the corresponding one of the four panels, thereby selectively restricting movement of the second portion in the corresponding detrusion direction of the one the four panels, each of the plurality of locking members includes a contact surface that contacts the second portion of a corresponding one of the four panels, the second portion being spaced apart from the first portion of the corresponding one of the four panels; and a mover device attached to the frame structure and being spaced apart from the plurality of detruding members, the mover device being connected to each of the locking members and being configured to simultaneously move the locking members in vertical direction from a first position to a second position such that in the first position each of the contact surfaces remains at respective predetermined fixed positions and contact the second portion of the corresponding one of the four panels, and during movement of the locking members from the first position to the second position the second portions of the four panels are simultaneously released from corresponding ones of the locking members.

2. The cardboard box assembly apparatus according to claim 1 wherein the locking members, the detruding members and the mover device are operated such that with the locking members in the first position the second portions are locked by the locking members and the first portions begin to undergo detrusion by the detruding members, the mover device simultaneously moving the locking members vertically upward from the first position toward the second position, and the detruding members further detrude the first portions.

3. The cardboard box assembly apparatus according to claim 1, wherein each of the locking members includes a fastening section and a plate member that includes the contact surface, the plate member being configured to adjustably tilt with respect to the fastening section.

4. The cardboard box assembly apparatus according to claim 3, wherein each of the locking members further includes an angle adjusting mechanism that connects the fastening section with the plate member for adjusting a tilt angle of the contact surface of the plate member with respect to the horizontal plane.

5. The cardboard box assembly apparatus according to claim 1, wherein the mover device includes a rotation mechanism, the rotation mechanism being configured to rotate the locking members so as to move the contact surface upwardly.

6. The cardboard box assembly apparatus according to claim 1, wherein the mover device holds a plurality of the locking members in an integrated manner.

7. The cardboard box assembly apparatus according to claim 1, wherein the mover device includes a plurality of mover units, each of the mover units holds a corresponding one of the plurality of the locking members in independent fashion.

8. The cardboard box assembly apparatus according to claim 1, further comprising a plurality of pushing members configured to push the lid downward from above in a vertical direction, once the four panels have been overlapped.

9. The cardboard box assembly apparatus according to claim 1, further comprising a plurality of lid erection devices for changing the posture of the four panels, wherein each of the lid erection devices includes: a rod member having a distal end section, and a rotation device for bringing about rotational movement of the rod member.

10. The cardboard box assembly apparatus according to claim 2, wherein each of the locking members includes fastening section and a plate member that includes the contact surface, the plate member being configured to adjustably tilt with respect to the fastening section.

11. The cardboard box assembly apparatus according to claim 4, wherein the mover device includes a rotation mechanism, the rotation mechanism being configured to rotate the locking members so as to move the contact surface upwardly.

12. The cardboard box assembly apparatus according to claim 3, wherein the mover device holds a plurality of the locking members in an integrated manner.

13. The cardboard box assembly apparatus according to claim 5, wherein the mover device holds a plurality of the locking members in an integrated manner.

14. The cardboard box assembly apparatus according to claim 3, further comprising a plurality of pushing members configured to push the lid downward from above in a vertical direction, once the four panels have been overlapped.

15. The cardboard box assembly apparatus according to claim 5, further comprising a plurality of pushing members configured to push the lid downward from above in a vertical direction, once the four panels have been overlapped.

16. The cardboard box assembly apparatus according to claim 5, further comprising a plurality of lid erection devices for changing the posture of the four panels, wherein each of the lid erection devices includes: a rod member having a distal end section, and a rotation device for bringing about rotational movement of the rod member.

* * * * *